US011840786B2

(12) United States Patent
Shiratsuchi

(10) Patent No.: US 11,840,786 B2
(45) Date of Patent: Dec. 12, 2023

(54) SEWING MACHINE

(71) Applicant: JANOME SEWING MACHINE CO., LTD., Tokyo (JP)

(72) Inventor: Hiroki Shiratsuchi, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 627 days.

(21) Appl. No.: 16/950,974

(22) Filed: Nov. 18, 2020

(65) Prior Publication Data

US 2021/0230782 A1 Jul. 29, 2021

(30) Foreign Application Priority Data

Jan. 29, 2020 (JP) ..... 2020-012175

(51) Int. Cl.
*D05B 65/02* (2006.01)
*D05B 87/02* (2006.01)

(52) U.S. Cl.
CPC ..... *D05B 65/02* (2013.01); *D05B 87/02* (2013.01)

(58) Field of Classification Search
CPC ..... D05B 65/00; D05B 65/02; D05B 65/003
See application file for complete search history.

(56) References Cited

U.S. PATENT DOCUMENTS 4,589,362 A * 5/1986 Dusch ..... D05B 65/00 112/300
8,087,367 B2 1/2012 Niizeki et al.
8,312,824 B2 11/2012 Niizeki et al.
2008/0250995 A1* 10/2008 Hanada ..... D05B 65/02 112/285
2009/0199753 A1 8/2009 Niizeki et al.
2009/0211505 A1* 8/2009 Hanada ..... D05B 65/00 112/285
2012/0031316 A1 2/2012 Niizeki et al.

FOREIGN PATENT DOCUMENTS

JP 5115226 B2 1/2013

* cited by examiner

*Primary Examiner* — Nathan E Durham
(74) *Attorney, Agent, or Firm* — Nakanishi IP Associates, LLC

(57) ABSTRACT

A sewing machine is provided with a function of adjusting a thread margin remaining on a cloth side to be sewn to a desired amount. A sewing machine includes a cutting member and a thread length adjustment mechanism. The cutting member cuts an upper thread and a lower thread between a hole of a needle plate and the cutting member. The thread length adjustment mechanism adjusts the length of the upper thread and the lower thread extending from the hole of the needle plate up to the cutting member.

5 Claims, 23 Drawing Sheets

SEWING MACHINE

CROSS REFERENCE TO RELATED APPLICATION

This application claims priority to Japanese Patent Application No. 2020-012175 filed on Jan. 29, 2020, the entire content of which is incorporated by reference.

BACKGROUND OF THE INVENTION

1. Field of the Invention

The present invention relates to a sewing machine.

2. Description of the Related Art

A thread cutting apparatus of a sewing machine is disclosed in Patent document 1 listed below. The thread cutting apparatus incudes a first thread capture member, a cutting blade, and a second thread capture member.

The first thread capture member is supported such that it can be reciprocally moved so as to capture an upper thread and a lower thread. The cutting blade is fixedly arranged at a position away from the trajectory of the first thread capture member toward a needle hole side. The second thread capture member operates together with the cutting blade to cut the upper thread and the lower thread thus captured by the first thread capture member, at a timing during the returning movement of the first thread capture member.

With the thread cutting apparatus having such a configuration, there is a fixed position relation between the needle hole and the cutting blade. This allows the upper thread and the lower thread to be sewn with a constant and small thread margin remaining on a cloth side to be sewn.

RELATED ART DOCUMENTS

Patent Documents

[Patent document 1]
Japanese Patent No. 5,115,226

SUMMARY OF THE INVENTION

Disclosure of the Invention

Problem to be Solved by the Invention

For example, in a case in which sewing is performed for a quilt cloth as a cloth to be sewn, both the outer fabric and the lining fabric are works. Accordingly, a technique is known in which, instead of leaving each thread end as it is, the sewing machine user forms a knot in each thread end, and embeds the knot thus formed in the quilt cloth. Such a technique requires a sufficient thread margin on the cloth to be sewn to form a knot in the thread end.

However, the thread cutting apparatus described above is configured to provide a short thread margin. Accordingly, it is difficult for such a thread cutting apparatus to support sewing using a quilt cloth in the example as described above. Accordingly, there is a demand for developing a sewing machine including a thread cutting apparatus which is not readily subject to restrictions in terms of the kind of the cloth to be sewn and the sewing method.

The present invention has been made in view of the above-described facts. Accordingly, the present invention has been made in order to provide a sewing machine that is capable of adjusting the thread remaining on the cloth side to be sewn to a desired amount.

Means to Solve the Problem

A first embodiment of the present invention relates to a sewing machine. The sewing machine includes: a cutting member configured to cut an upper thread and a lower thread between a hole of a needle plate and a rotating hook; and a thread length adjustment mechanism configured to adjust the length of the upper thread and the lower thread extending from the hole of the needle plate and the cutting member.

A second embodiment of the present invention relates to the sewing machine according to the first embodiment. In the sewing machine, the thread length adjustment mechanism is arranged between the hole of the needle plate and the cutting member, and is configured including an adjustment blade portion that is capable of capturing and moving the upper thread and the lower thread.

A third embodiment of the present invention relates to the sewing machine according to the second embodiment. The sewing machine includes a guide portion arranged between the hole of the needle plate and the adjustment blade portion, and configured to guide the upper thread and the lower thread when the adjustment blade portion is moved.

A fourth embodiment of the present invention relates to the sewing machine according to the first embodiment. In the sewing machine, the thread length adjustment mechanism is configured including a movement mechanism that moves the cutting member relative to the hole of the needle plate.

A fifth embodiment of the present invention relates to the sewing machine according to any one of the first embodiment through the fourth embodiment. The sewing machine further includes a thread capture member configured to capture the upper thread and the lower thread between the hole of the needle plate and the rotating hook, and to move relative to the cutting member.

A sixth embodiment of the present invention relates to the sewing machine according to any one of the first embodiment through the fifth embodiment. The sewing machine further includes: an operating unit configured to set a thread margin of the upper thread and the lower thread to be set for a cloth side to be sewn and to be used for the thread length adjustment mechanism; a driving source configured to drive the thread length adjustment mechanism; and a control unit (controller) configured to drive the driving source based on the thread margin set by the operating unit.

Advantage of the Present Invention

With the present invention, a sewing machine is provided with a function of adjusting a thread margin remaining on a cloth side to be sewn to be adjusted to a desired amount.

DESCRIPTION OF THE PREFERRED EMBODIMENTS

Figure 1:
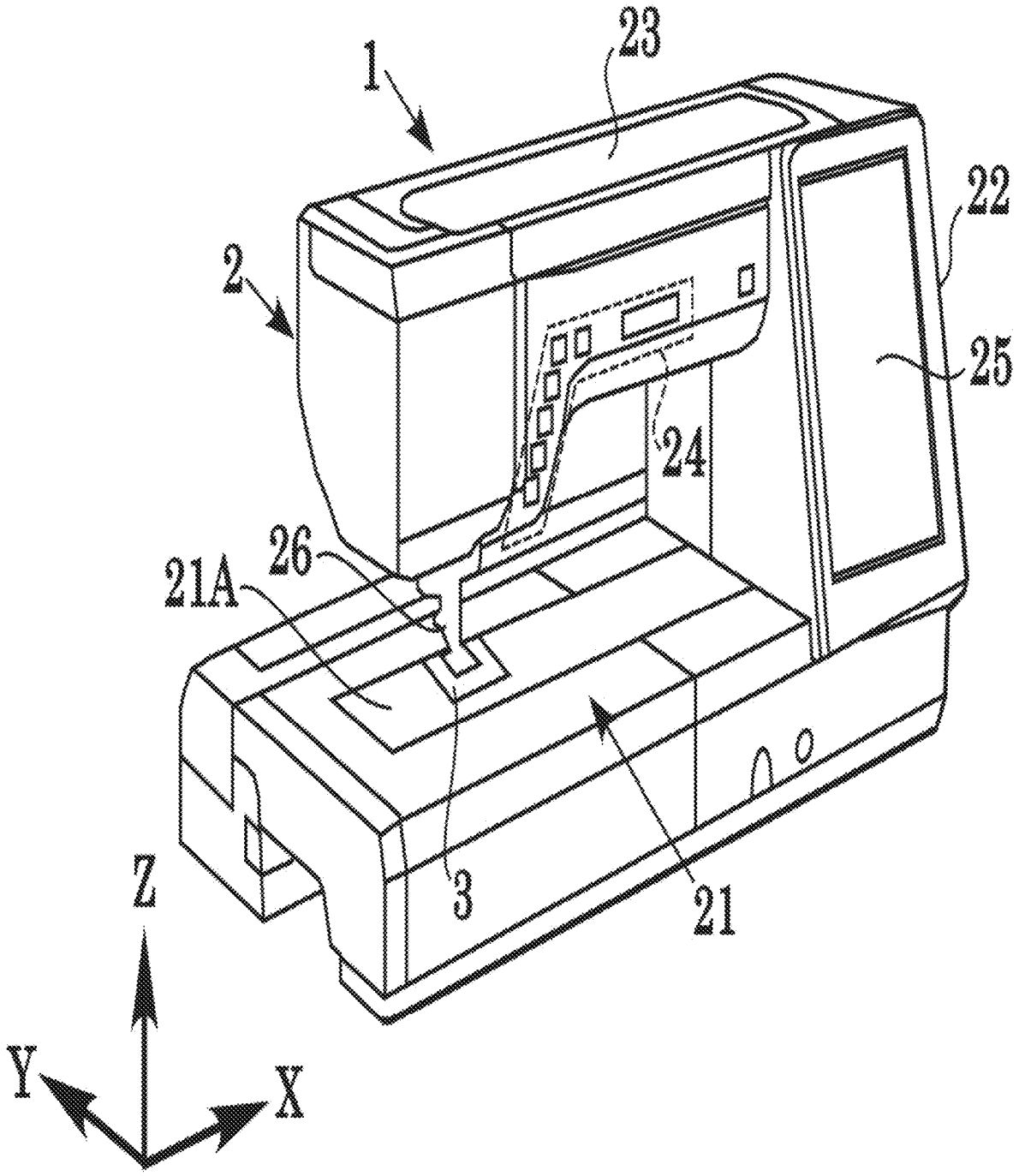
FIG. 1 is a perspective view showing an external view of a sewing machine according to a first embodiment of the present invention.

Description will be made with reference to the drawings regarding a sewing machine according to an embodiment of the present invention.

It should be noted that, in the drawings, the arrow X indicates the X-axis direction, the arrow Y indicates the Y-axis direction, and the arrow Z indicates the Z-axis direction, as appropriate, in a three-dimensional coordinate system. The Y-axis direction is orthogonal to the X-axis direction on a horizontal plane. The Z-axis direction is orthogonal to the X-axis direction and the Y-axis direction. For ease of understanding in the description of the present embodiment, such directions are defined for convenience. That is, they are by no means intended to restrict the directions in the present invention.

First Embodiment

Description will be made with reference to FIGS. 1 through 16 regarding a sewing machine according to a first embodiment of the present invention, a thread cutting apparatus included in the sewing machine, and a thread cutting method including a thread length adjustment method for adjusting the thread length on a cloth side to be sewn.

[Overall Configuration of Sewing Machine 1]

As shown in FIG. 1, the sewing machine 1 includes a sewing machine main body 2. The sewing machine main body 2 is configured including a bed 21, a pillar portion 22, and an arm portion 23.

The bed 21 is configured to have a rectangular shape with the left-right direction which is the arrow X direction as its longitudinal direction, with the front-rear direction which is the arrow Y direction as its transverse direction, and with the height direction which is the arrow Z direction as its thickness direction. The bed 21 has an upper face configured as a horizontal bed face (or sewing operation face) 21A. A needle plate 3 is arranged on the bed face 21A at an intermediate position in the left-right direction and in the front-rear direction thereof.

The pillar portion 22 is installed such that it stands erect on and extends upward from the right-side end portion of the bed 21. The pillar portion 22 and the bed 21 are configured as a single unit or such that they function as a single unit.

A display unit 25 is arranged on the front face of the pillar portion 22. The display unit 25 is configured as a liquid crystal display, for example. In this example, a touch panel is built into the liquid crystal display. The display unit 25 allows various kinds of messages to be displayed, and allows the sewing machine user to perform various kinds of operations such as settings or the like with respect to the sewing. That is, description will be made in the present embodiment regarding an example in which the display unit 25 is also configured to function as an operating unit.

The arm portion 23 is configured such that it extends toward the left-direction side from an upper portion of the pillar portion 22 such that it faces the bed 21. The arm portion 23 and the pillar portion 22 are formed as a single unit or such that they function as a single unit.

An operating unit 24 is arranged on the arm portion 23 at an intermediate position in the left-right direction thereof such that it is positioned in front of the sewing machine user side. Various kinds of operating buttons (or switches) are arranged on the operating unit 24, examples of which include a sewing start/stop button, a backstitching button, a staystitching button, an up/down needle stop button, a thread cutting button, a presser up/down movement button, sewing speed adjustment button, etc.

Furthermore, a sewing portion 26 is arranged on the arm portion 23 such that it is positioned at the left-side end portion and the lower portion thereof. The sewing portion 26 is configured including a sewing machine needle (sewing needle) and a needle bar to which the sewing machine needle is to be attached. Detailed description of the configuration is omitted. Furthermore, the sewing portion 26 includes a presser plate configured to press a sewing target, e.g., a cloth to be sewn, into contact with the needle plate 3 and the bed face 21A, and a presser bar that supports the presser plate.

Figure 5:
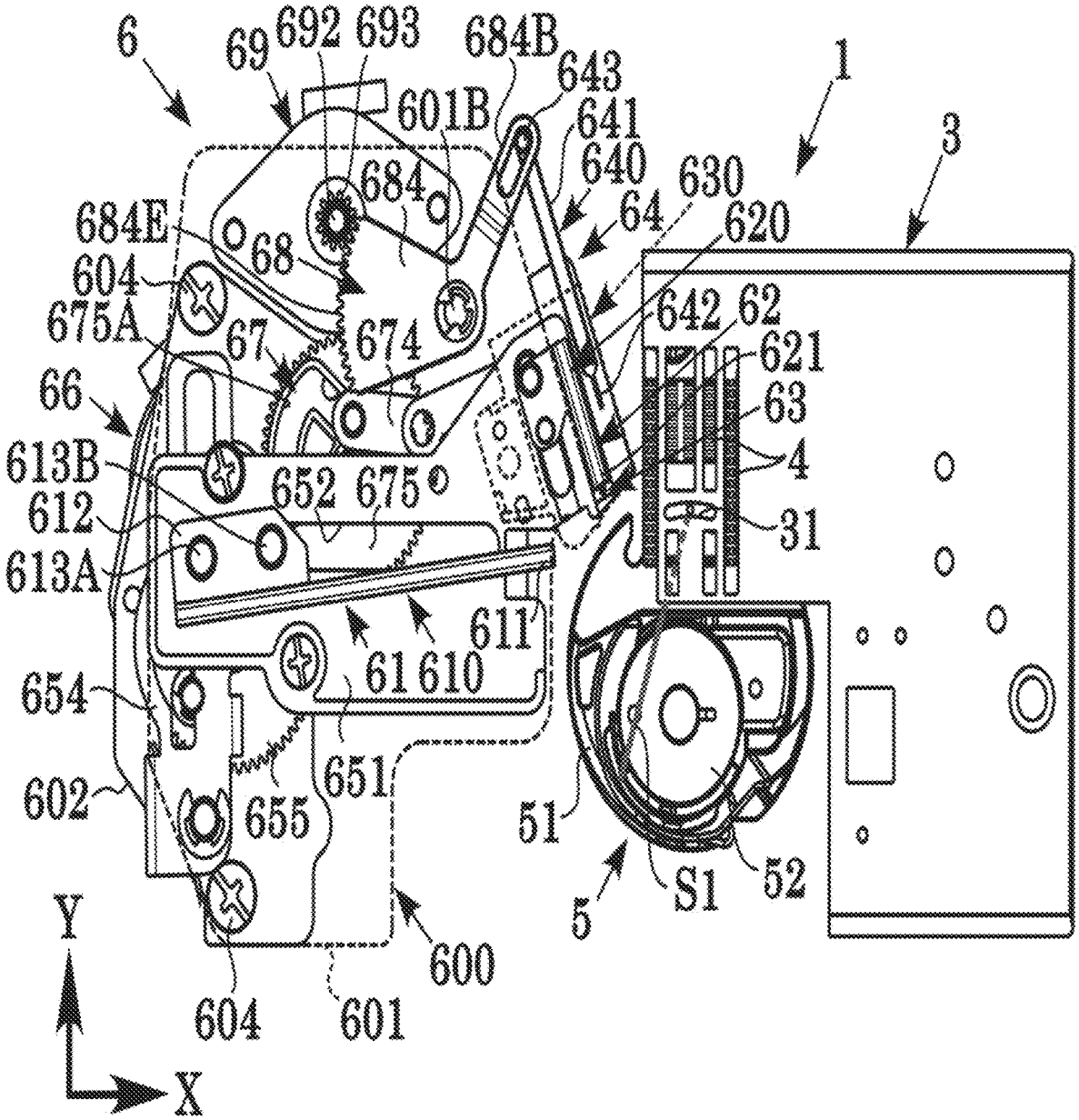
FIG. 5 is a plan view showing the thread cutting apparatus and a part of components of the sewing machine in a first step for explaining a thread cutting method employed in the sewing machine according to the first embodiment.

FIG. 5 shows the right-side-half portion of the needle plate 3 in a plan view. FIG. 5 does not show the left-side-half portion thereof. The needle plate 3 is configured as a metal plate member having an opening that faces the front face side thereof with the upper-lower direction as its thick direction such that it has a reverse U-shaped structure in a plan view. A through hole 31 is formed as a needle hole (or needle opening) in the needle plate 3 at an intermediate portion defined in the left-right direction and the front-rear direction thereof.

Feed dogs 4 are arranged on both sides and on the front and rear sides of the hole 31. The feed dogs 4 are configured to be driven in the front-rear direction and the upper-lower direction in cooperation with an unshown feed mechanism according to the up-down driving operation of the sewing machine needle so as to feed a cloth to be sewn.

A rotating hook 5 is arranged as an internal component of the bed 21 at a position on the front face side of and below the needle plate 3. The rotating hook 5 is configured including an inner hook 51 and an unshown outer hook. A bobbin 52 is housed in the inner hook 51 in a state in which a lower thread S1 is wound around the bobbin 52. The bobbin 52 is rotatably and detachably housed in an internal space of the inner hook 51.

[Configuration of the Thread Cutting Apparatus 6]

As shown in FIG. 5, a thread cutting apparatus 6 is arranged such that it is positioned below the needle plate 3 and on the left side with respect to the hole 31 and the feed dogs 4 defined in the left-right direction. That is, the thread cutting apparatus 6 is arranged within the bed 21, and is arranged adjacent to the left side of the rotating hook 51 as viewed from the sewing machine user side.

As shown in FIGS. 2, 3A through 3C, 4, and 5, the thread cutting apparatus 6 includes a first thread capture member 61, a second thread capture member 62, a cutting member 63, and a thread length adjustment mechanism 64 as its main components. Detailed description will be made below regarding each component of the thread cutting apparatus 6.

(1) Configuration of Support Housing 600 of Thread Cutting Apparatus 6

The thread cutting apparatus 6 includes a support housing 600 that supports its main components such as the first thread capture member 61, etc. The support housing 600 is configured including a first frame 601 and a second frame 602.

The first frame 601 is configured as a metal or resin plate member in a polygonal shape without a corner on the right-front side in a plan view with the upper-lower direction as its thickness direction. As with the first frame 601, the second frame 602 is also configured as a metal or resin plate member in a polygonal shape without a corner on the right-front side in a plan view with the upper-lower direction as its thickness direction.

The second frame 602 is arranged on the lower-left face of the first frame 601 with a gap between them via pipe-shaped spacers 603 with the upper-lower direction as the pipe-shaped shaft direction such that it extends in parallel with the first frame 601. The spacers 603 are arranged on the front side and the rear side in the front-rear direction, respectively. That is, the total number of the spacers 603 is two. Furthermore, the first frame 601 and the second frame 602 are coupled via coupling members 604 that each pass through the internal space of the corresponding spacer 603. As such a coupling member 604, a small screw (or other screw or bolt) having a male screw structure is employed, for example. Furthermore, a hole having an unindicated female screw structure is formed in the second frame 602 at a position that corresponds to each coupling member 604.

(2) Configuration of First Thread Capture Member 61, First Driving Mechanism 65, and First Driving Source 66

The first thread capture member 61 includes a thread capture member main body 610 arranged with the left-right direction as its longitudinal direction. The thread capture member main body 610 is formed to have a reverse U-shaped structure having an opening that, supposing it to be cut by a plane in parallel with the Y-Z plane, faces downward. A plate-shaped slide portion 612 is formed in the left-side end portion of the thread capture member main body 610 in the form of a single unit or such that they function as a single unit. Furthermore, the slide portion 612 is configured such that it protrudes toward the rear face side with the upper-lower direction as its thickness direction. A first pin 613A is arranged on a left-side portion of the slide portion 612 such that it passes through the slide portion 612. Furthermore, a second pin 613B is arranged on the right side with respect to the first pin 613A such that it passes through the slide portion 612.

Figure 2:
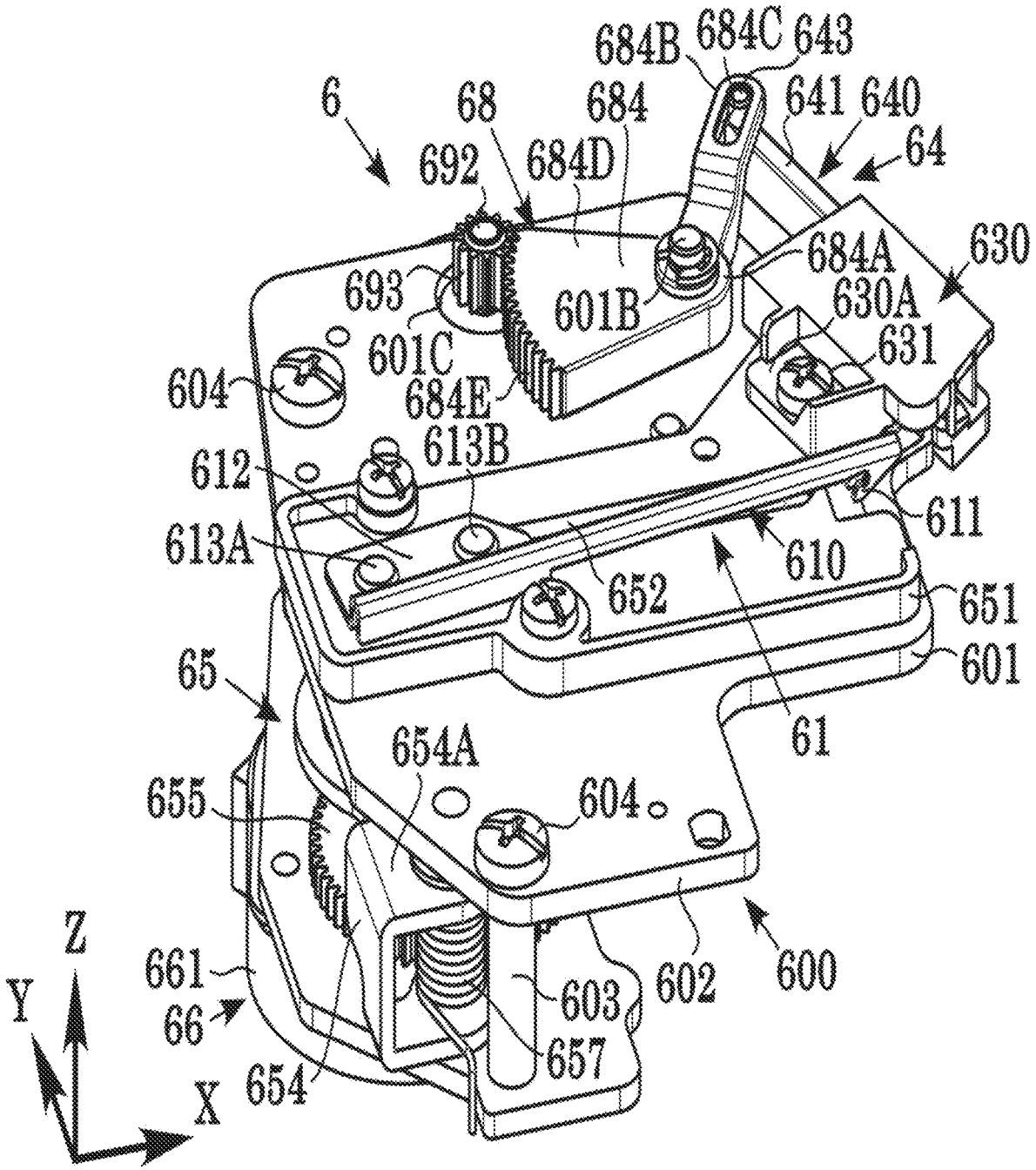
FIG. 2 is a perspective view showing a thread cutting apparatus included in the sewing machine according to the first embodiment.
Figure 3A:
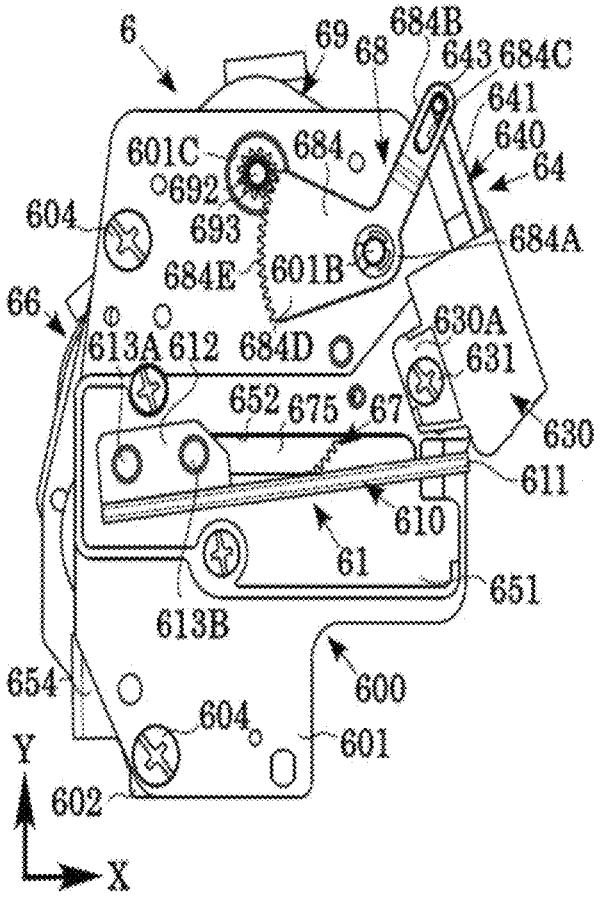
FIG. 3A is a plan view showing the thread cutting apparatus shown in FIG. 2 as viewed from the upper side.
Figure 3B:
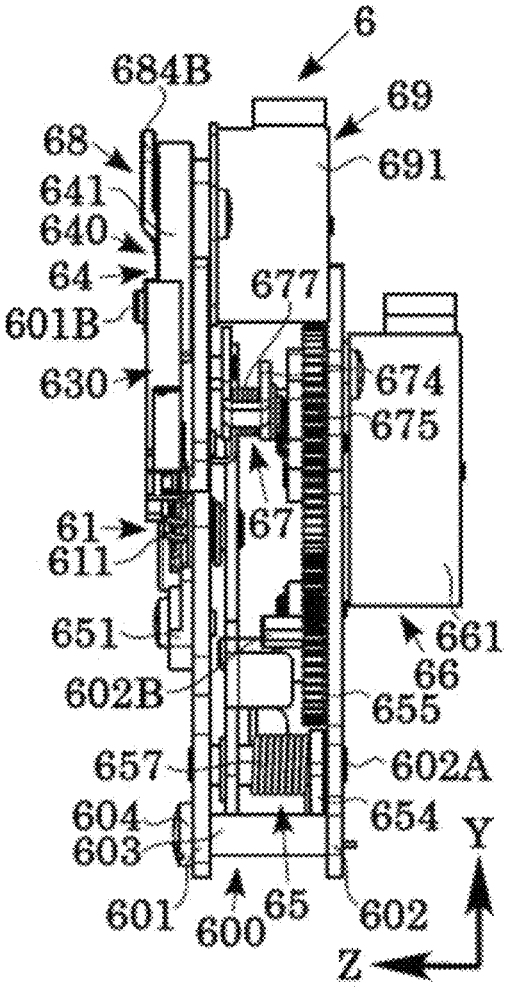
FIG. 3B is a side view showing the thread cutting apparatus shown in FIG. 2 as viewed from the X-axis direction.
Figure 3C:
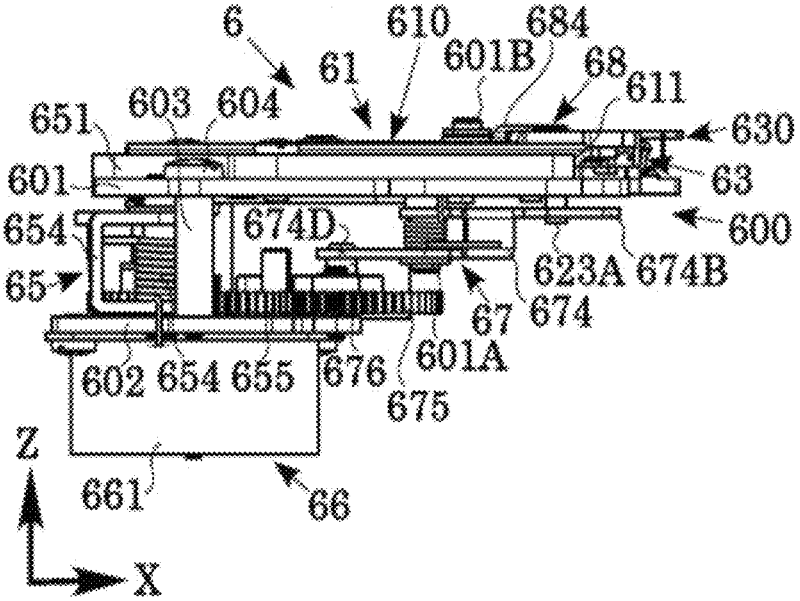
FIG. 3C is a front view showing the thread cutting apparatus shown in FIG. 2 as viewed from the Y-axis direction.
Figure 4:
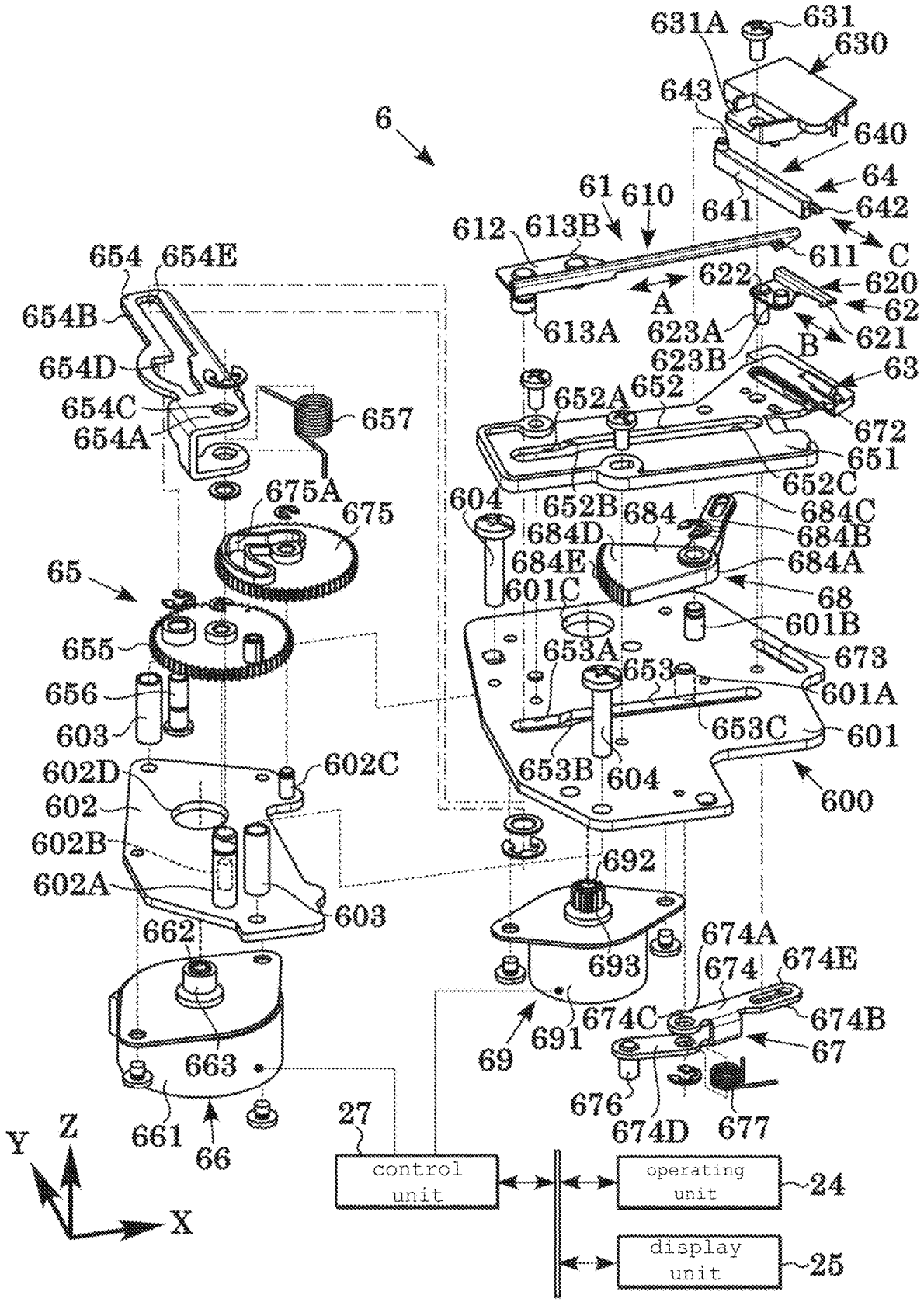
FIG. 4 is an exploded perspective view showing the thread cutting apparatus shown in FIGS. 2 and 3A-3C including a part of components of the sewing machine shown in FIG. 1.

As shown in FIGS. 2 and 4, a thread capture portion 611 is formed in the right-side end portion of the thread capture member main body 610 in the form of a single unit or such that they function as a single unit. The thread capture member 611 is formed to have a hook shape such that the right-side end portion of the thread capture member main body 610 is bent toward a lower-left side as viewed from the sewing machine user side.

Figure 8:
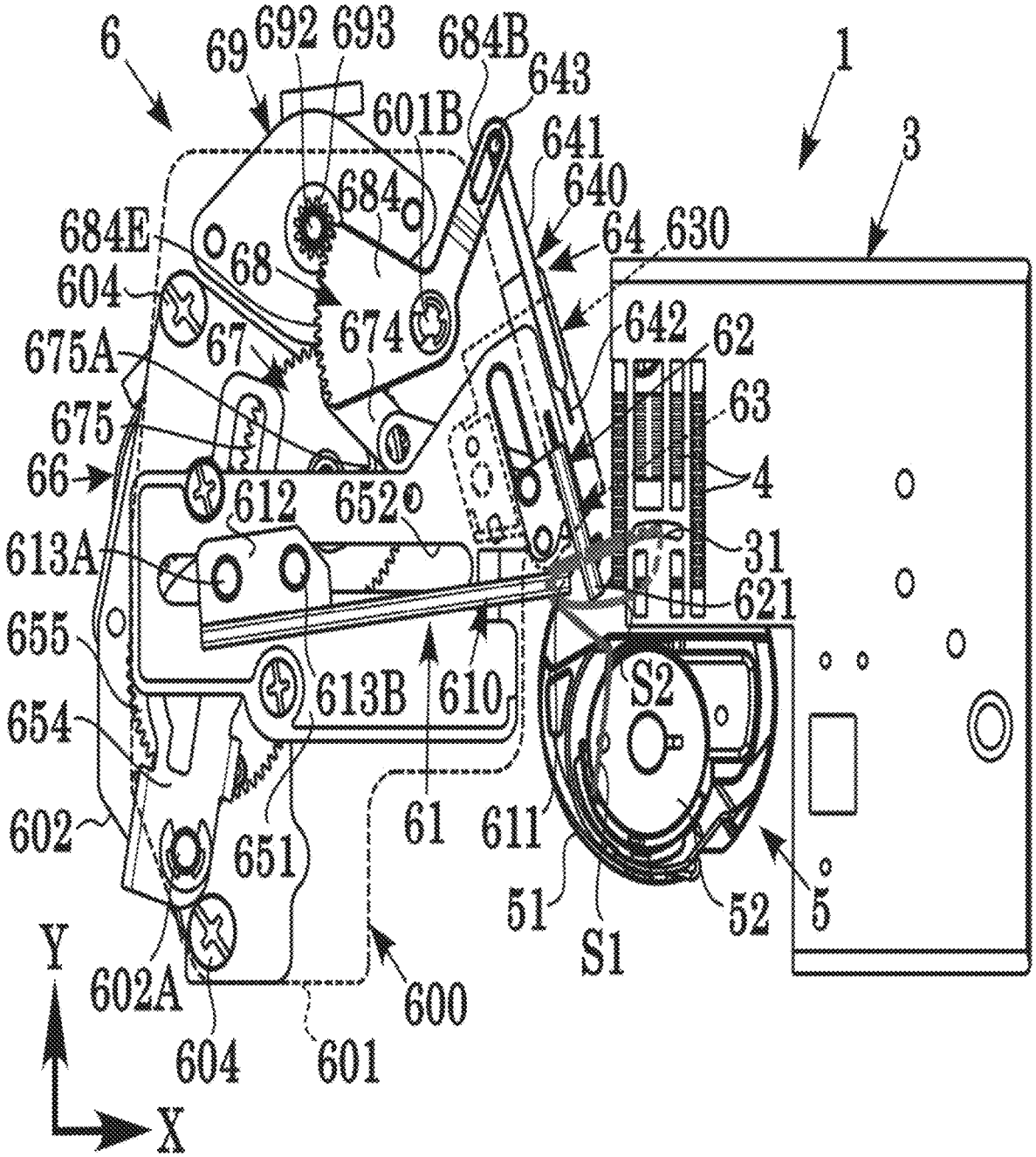
FIG. 8 is a plan view showing the thread cutting apparatus and a part of components of the sewing machine in a fourth step that corresponds to FIG. 5.

The thread capture portion 611 is reciprocally moved in the arrow A direction (see FIG. 4), i.e., the left-right direction, between the hole 31 of the needle plate 3 and the rotating hook 5 shown in FIG. 5. The thread capture portion 611 is configured to operate such that the upper thread S2 and the lower thread S1 are hooked and drawn toward the left side as shown in FIG. 8. That is, the thread capture portion 611 is configured to capture the upper thread S2 and the lower thread S1.

As shown in FIG. 4, the first thread capture member 61 is coupled to the first driving mechanism 65. The first thread capture member 61 is configured to be reciprocally moved using the first driving mechanism 65. The first driving mechanism 65 is coupled to the first driving source 66. The driving force provided by the first driving source 66 is transmitted via the first driving mechanism 65 so as to reciprocally drive the first thread capture member 61. The first driving mechanism 65 includes as its main components a first slide guide 651, a first driving lever 654, a first driven gear 655, a driving pin 656, and an elastic member 657.

The first slide guide 651 is formed to have a plate shape with the upper-lower direction as its thickness direction, with the left-right direction as its longitudinal direction, and with the front-rear direction as its transverse direction. The first slide guide 651 is arranged such that it is overlaid on the first frame 601. Furthermore, the first slide guide 651 is attached to the first frame 601 by an unindicated coupling member. As such a coupling member, a small screw is employed, for example.

A guide groove 652 is formed in the first slide guide 651 such that it passes through the first slide guide 651 in the upper-lower direction and such that it extends in the left-right direction. The guide groove 652 is configured including a base-end groove 652A that extends from the left end toward the right end, a swing groove 652B that extends diagonally from the right end of the base end groove 652A toward the right-rear side, and a capture groove 652C that extends from the right end of the swing groove 652B toward the right side such that they communicate with each other. The capture groove 652C is formed such that it extends in parallel with the base end groove 652A.

In a plan view, a guide groove 653 is formed in the first frame 601 to have the same shape as that of the guide groove 652 such that it matches a position that corresponds to the guide groove 652. That is, the guide groove 653 is configured including a base end groove 653A, a swing groove 653B, and a capture groove 653C such that they communicate with each other. The base end groove 653A is arranged at a position that corresponds to the base end groove 652A, and is formed to have the same shape as the base end groove 652A. The swing groove 653B is arranged at a position that corresponds to the swing groove 652B, and is formed to have the same shape as the swing groove 652B. The capture groove 653C is arranged at a position that corresponds to the capture groove 652C, and is formed to have the same shape as the capture groove 652C. The guide groove 653 is configured as a component that forms the first driving mechanism 65.

The first pin 613A and the second pin 613B of the first thread capture member 61 are mounted on the guide groove 652 of the first slide guide 651 and the guide groove 653 of the first frame 601 such that they pass through the guide grooves 652 and 652. That is, the first pin 613A and the second pin 613B are configured such that they can be moved along the guide grooves 652 and 653. This arrangement allows the first thread capture member 61 to be reciprocally moved in the left-right direction along the shapes of the guide grooves 652 and 653.

The first driving lever 654 is configured including a rotating portion 654A arranged on the front face side and a lever portion 654B monolithically formed with the rotating portion 654A such that it extends toward the rear face side. The rotating portion 654A includes an upper plate configured with the upper-lower direction as its thickness direction, a lower plate arranged below the upper plate such that it extends in parallel with the upper plate, and a side plate that couples the left end of the upper plate and the left end of the lower plate. The rotating portion 654A is configured to have a C shape having an opening that faces the right side as viewed from the sewing machine user side. A rotating shaft opening 654C is formed in each of the upper plate and the lower plate of the rotating portion 654A such that it passes through in the upper-lower direction.

A rotational shaft 602A is inserted into the rotational shaft openings 654C with the upper-lower direction as its axial direction. The lower end of the rotational shaft 602A is fixedly mounted on the upper face of the second frame 602. The rotating portion 654A is rotatably mounted on the rotational shaft 602A.

The lever portion 654B is formed to have a plate shape, monolithically with the upper plate of the rotating portion 654A. The lever portion 654B is configured to have a driving groove 654D arranged on a front face side such that it passes through in the upper-lower direction, and a driven groove 654E arranged on the rear face side such that it communicates with the driving groove 654D and such that it passes through in the upper-lower direction. The driving pin 656 is mounted on the first driven gear 655 at a position with a displacement away from the center of the first driven gear 655 toward the outer side in the radial direction. Furthermore, the driving pin 656 is inserted into the driving groove 654D. On the other hand, a first pin 613A of the first thread capture member 61 is inserted into the driven groove 654E.

When the first driven gear 655 is rotated in a clockwise manner in a plan view, the driving pin 656 is rotated in the same direction. The rotation of the driving pin 656 rotates the first driving lever 654 in a clockwise manner. Accordingly, the first pin 613A is moved from the left side toward the right side along the driven groove 654E. This moves the first thread capture member 61 from the left side toward the right side (advancing movement, see FIG. 6).

Conversely, when the first driven gear 655 is rotated in the reverse direction, i.e., in a counterclockwise manner, the driven pin 656 is rotated in the reverse rotational direction which is the same as that of the first driven gear 655. The reverse rotation of the driving pin 656 rotates the first driving lever 654 in a counterclockwise manner. In this case, the first pin 613A is moved from the right side toward the left side along the driven groove 654E. This moves the first thread capture member 61 from the right side toward the left side (returning movement, see FIG. 5).

The rotational shaft 602B is inserted into an unindicated rotational shaft opening of the first driven gear 655 with the upper-lower direction as the axial direction. The lower end of the rotational shaft 602B is fixedly attached to the upper face of the second frame 602. That is, the first driven gear 655 is rotatably mounted on the rotational shaft 602B.

The first driving source 66 is arranged below the second frame 602. In the present embodiment, the first driving source 66 is configured including a stepping motor 661. The stepping motor 661 is fixedly mounted on the second frame 602 with the axial direction of the rotational shaft 662 as the upper-lower direction. A driving gear 663 is mounted on the rotational shaft 662. The rotational shaft 662 and the driving gear 663 are arranged such that they protrude toward the upper face side of the second frame 602 via a coupling opening 602D formed as a through hole in the second frame 602. The driving gear 663 is configured to mesh with the first driven gear 655.

The stepping motor 661 is connected to a control unit (e.g., controller including one or more processors) 27 that controls the overall operation of the sewing machine 1 shown in FIG. 1, or is connected to the control unit 27 via an unshown motor driver. The rotation of the stepping motor 661 is controlled according to an instruction received from the control unit 27. Furthermore, the control unit 27 is interconnected with the operating unit 24, the display unit 25, etc., via a common bus.

The elastic member 657 is arranged at an axial-direction intermediate portion of the rotational shaft 602A that functions as the center of the rotational axis of the first driving lever 654 such that it is interposed between the upper plate and the lower plate of the rotating portion 654A. As the elastic member 657, a torsion coil spring is employed in this example. One end portion of the elastic member 657 is engaged with the second frame 602. The other end portion of the elastic member 657 is engaged with the first driving lever 654. The elastic member 657 applies force at all times in a direction such that it causes the first driving lever 654 to rotate in a counterclockwise direction.

(3) Configuration of Second Thread Capture Member 62 and Second Driving Mechanism 67

As shown in FIGS. 4 and 5, the second thread capture member 62 includes a thread capture member main body 620 that extends with the front-rear direction as its longitudinal direction. Here, the thread capture member main body 620 configured such that it extends in the longitudinal direction is arranged with an angle of 60 to 90 degrees in a clockwise direction in a plan view with respect to the thread capture member main body 610 of the first thread capture member 61 arranged such that it extends in the longitudinal direction matching the X axis shown in FIG. 6. In this example, the thread capture member main body 620 is arranged with an angle of 65 degrees to 68 degrees with respect to the thread capture member main body 610. As with the thread capture member main body 610, the thread capture member main body 620 is formed to have a reverse U-shaped cross-sectional structure having an opening that, supposing it to be cut by a plane in parallel with the X-Z plane, faces downward.

Figure 6:
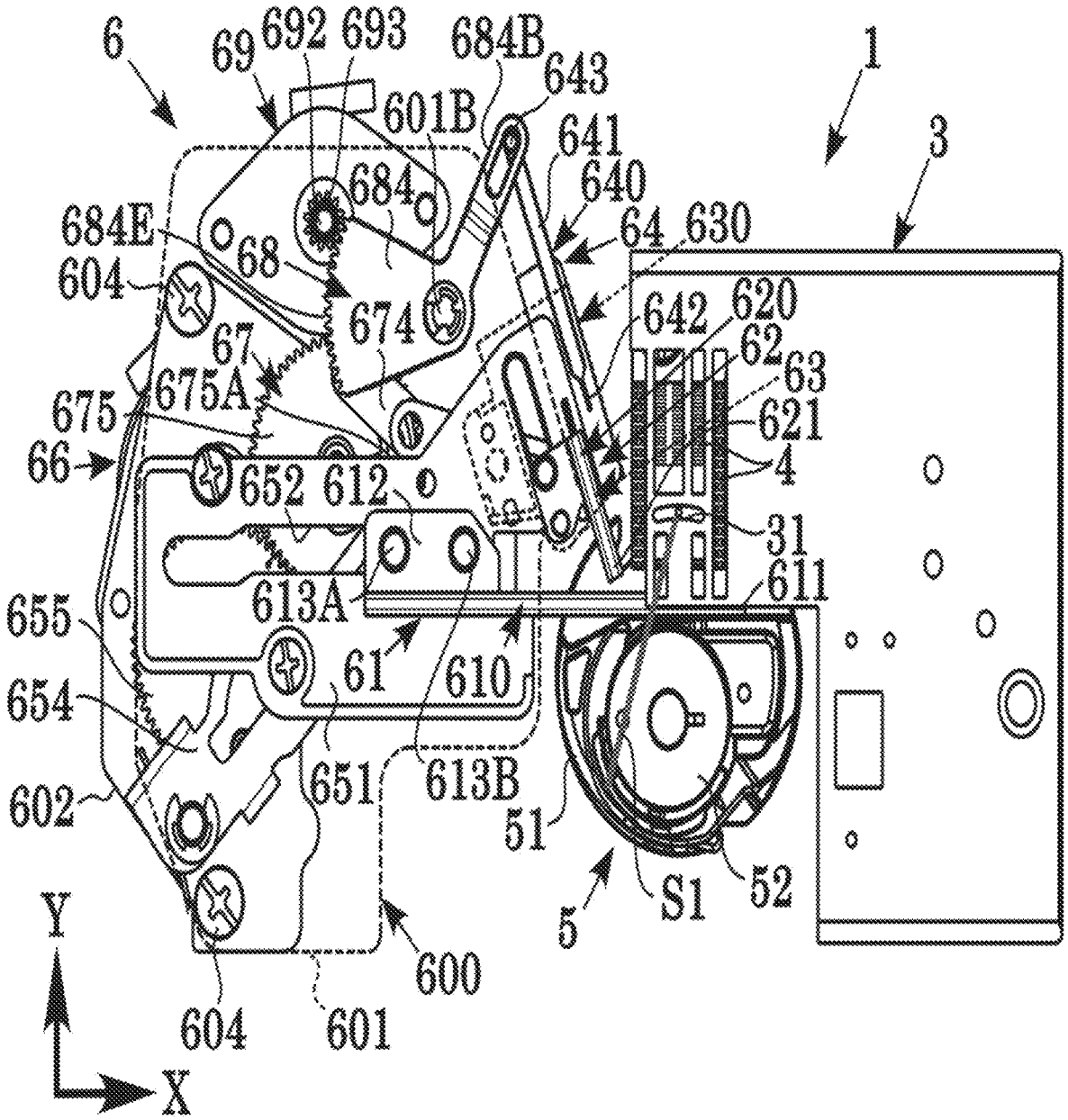
FIG. 6 is a plan view showing the thread cutting apparatus and a part of components of the sewing machine in a second step that corresponds to FIG. 5.

As shown in FIGS. 4 through 6, a plate-shaped slide portion 622 is formed in a rear-side end portion of the thread capture member main body 620 with the upper-lower direction as its thickness direction such that it protrudes toward the left side and such that they form a single unit or function as a single unit. A first pin 623A is provided to the slide portion 622 such that it passes through on the rear face side. Furthermore, a second pin 623B is provided to the slide portion 622 such that it passes through further to the front face side than the first pin 623A.

A thread capture portion 621 is formed in a front face side end portion of the thread capture member main body 620 such that they form a single unit or function as a single unit. As with the thread capture portion 611, the thread capture portion 621 is formed to have a hook shape such that the front face side end portion of the thread capture member main body 620 is bent toward the lower-rear side.

Figure 7:
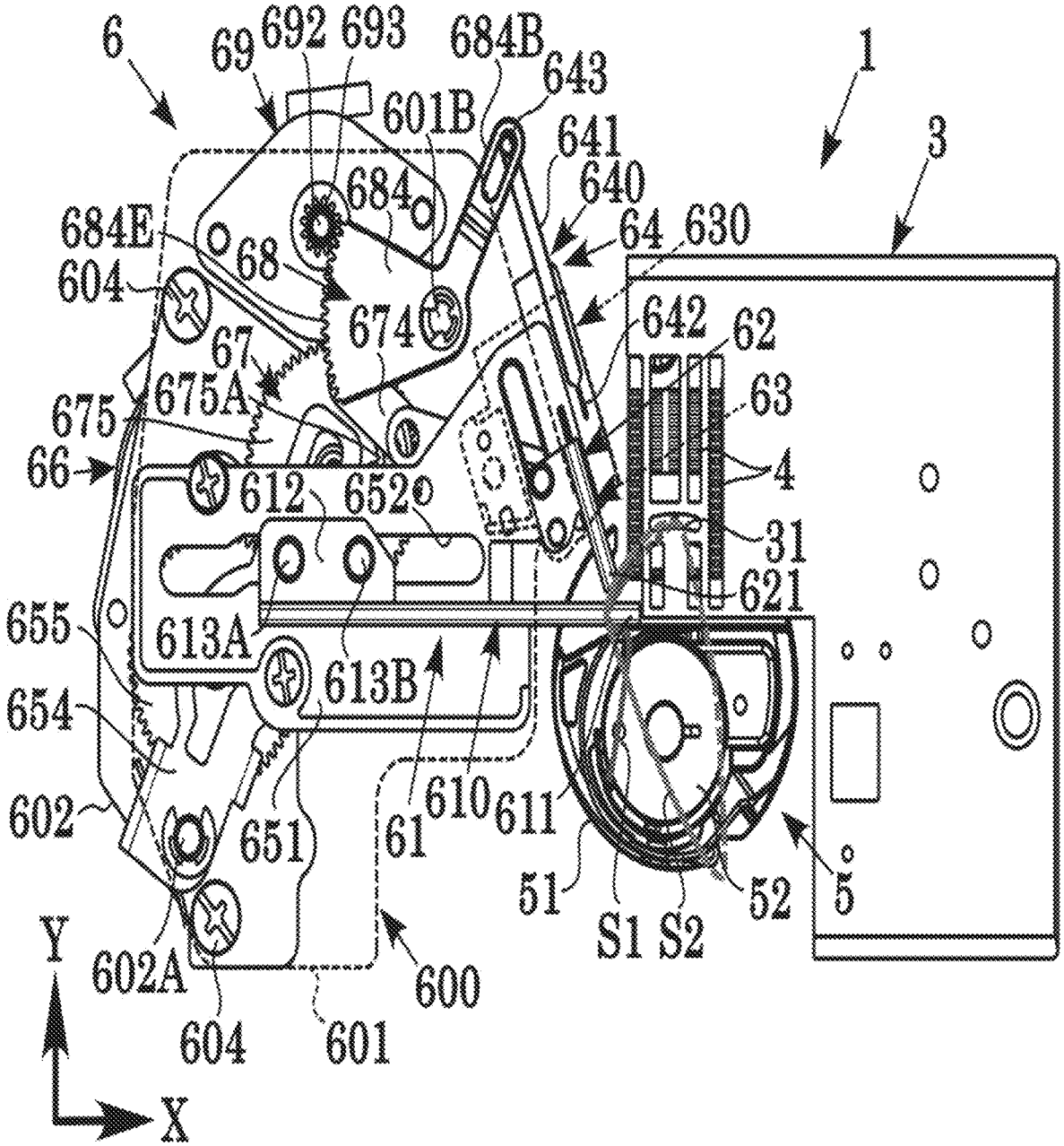
FIG. 7 is a plan view showing the thread cutting apparatus and a part of components of the sewing machine in a third step that corresponds to FIG. 5.

The thread capture portion 621 is configured such that it can be reciprocally moved in the front-rear direction which is the arrow B direction (see FIG. 4) between the hole 31 of the needle plate 3 and the rotating hook 5 shown in FIG. 5, so as to hook the upper thread S2 and the lower thread S1 and to draw the upper thread S2 and the lower thread S1 toward the rear face side as shown in FIG. 7.

Furthermore, the second thread capture member 62 is configured such that, when the second thread capture member 62 returns after it captures the upper thread S2 and the lower thread S1 using the thread capture portion 621, it cuts the upper thread S2 and the lower thread S1 in cooperation with the cutting member 63.

As shown in FIG. 4, the second thread capture member 62 is coupled to the second driving mechanism 67. The second thread capture member 62 is configured to be reciprocally moved using the second driving mechanism 67. The first driving source 66 is coupled to the second driving mechanism 67. The driving force of the first driving source 66 is transmitted via the second driving mechanism 67 so as to reciprocally move the second thread capture member 62. In the sewing machine 1 according to the present embodiment, the thread cutting apparatus 6 is configured to drive the two driving mechanisms, i.e., the first driving mechanism 65 and the second driving mechanism 67, using the single first driving source 66 so as to move the two thread capture members, i.e., the first thread capture member 61 and the second thread capture member 62. The second driving mechanism 67 includes, as its main components, the first slide guide 651 that is the same component of that of the first driving mechanism 65, a second driving lever 674, a second driven gear 675, a driven pin 676, and an elastic member 677.

A guide groove 672 is formed as a component that differs from the guide groove 652 in the first slide guide 651, at a position on the right side of the guide groove 652. The guide groove 672 is formed such that it passes through the first slide guide 651 in the upper-lower direction with the left-right direction as its width direction. Furthermore, the guide groove 672 is formed such that it extends in the front-rear direction with a constant width. That is, the extending direction of the guide groove 672 crosses the extending direction of the guide groove 652. In this example, as described above, they cross each other with an angle of 60 degrees to 90 degrees.

In a plan view, the first frame 601 is provided with a guide groove 673 having the same shape as that of the guide groove 672 such that it is arranged at a position that corresponds to the guide groove 672. The guide groove 673 is formed such that it passes through the first frame 601 in the upper-lower direction and such that it extends in the front-rear direction with a constant width. The guide groove 673 is configured as a component that forms the second driving mechanism 67.

The guide groove 672 of the first slide guide 651 and the guide groove 673 of the first frame 601 are configured to allow the first pin 623A and the second pin 623B of the second thread capture member 62 to be mounted such that they pass through the respective guide grooves. That is, this arrangement allows the first pin 623A and the second pin 623B to be moved along the guide grooves 672 and 673. This allows the second thread capture member 62 to be reciprocally moved in the front-rear direction according to the shapes of the guide grooves 672 and 673.

The second driving lever 674 is configured including a rotating portion 674A, a lever portion 674B monolithically formed with the rotating portion 674A such that it extends toward the right side in the left-right direction, and an extending portion 674D monolithically configured with the rotating portion 674A such that it extends toward the left side in the left-right direction. The rotating portion 674A includes an upper plate configured with the upper-lower direction as its thickness direction, a lower plate arranged below the upper plate such that it extends in parallel with the upper plate, and a side plate that couples the front face of the upper plate and the front face of the lower face. The rotating portion 674A is configured to have a C-shaped structure having an opening that faces the rear face side as viewed from the X-axis direction (side direction). A rotating shaft opening 674C is formed as an upper-lower direction through hole in each of the upper plate and the lower plate of the rotating portion 674A.

The rotational shaft 601A (see FIGS. 3C and 4) arranged with the upper-lower direction as its axial direction is inserted into the rotational shaft openings 674C. The upper end of the rotational shaft 601A is mounted on the lower face of the first frame 601. That is, the rotating portion 674A is rotatably mounted on the rotational shaft 601A.

The lever portion 674B is configured on the upper plate of the rotating portion 647A such that they form a single unit. Furthermore, the lever portion 674B is formed to have a plate-shaped structure that extends from the rotating portion 674A toward the right side. The lever portion 674B is provided with a driving groove 674E formed as an upper-lower direction through hole such that it extends in the left-right direction. The first pin 623A of the second thread capture member 62 is inserted into the driving groove 674E via the guide grooves 672 and 673.

The extending portion 674D is monolithically configured with the lower plate of the rotating portion 674A such that it has a plate-shaped structure with the upper-lower direction as its thickness direction. The driven pin 676 is provided to the lower face of the extending-direction end portion of the extending portion 674D such that it protrudes downward.

The driven pin 676 is inserted into the guide portion 675A provided to the second driven gear 675. The guide portion 675A includes a circumferential portion formed such that it extends in a clockwise direction with a constant width along the outer circumference of the second driven gear 675 in a plan view, and a bent portion formed such that it extends with a constant width from the end of the circumferential portion toward the center side in the radial direction. In a plan view, the guide portion 675A is formed to have an approximately V-shaped structure having an opening that faces the rotational center side of the second driven gear 675. The driven pin 676 is configured such that it can be moved along the guide portion 675A.

When the second driven gear 675 is rotated in a clockwise manner in a plan view, the driven pin 676 is moved toward the circumferential side of the second driven gear 675 in the radial direction along the guide portion 675A. When the driven pin 676 is moved toward the circumferential side in the radial direction, the lever portion 674B of the second driving lever 674 is rotated in a clockwise manner with the rotational shaft 601A as the rotational center, thereby moving the first pin 623A toward the front face side along the guide grooves 672 and 673. With this, the thread capture portion 621 of the second thread capture member 62 is moved from the rear face side toward the front face side (advancing movement, see FIG. 6).

When the second driven gear 675 is rotated in a counterclockwise manner in a plan view, the driven pin 676 is moved toward the center side of the second driven gear 675 in the radial direction of the second driven gear 675 along the guide portion 675A. When the driven pin 676 is moved toward the center side in the radial direction, the lever portion 674B of the second driving lever 674 is rotated in a counterclockwise manner with the rotational shaft 601A as the rotational center, thereby moving the first pin 623A toward the rear face side along the guide grooves 672 and 673. With this, the second thread capture member 62 is moved from the front face side toward the rear face side (returning movement, see FIG. 5).

A rotational shaft 602C is inserted into an unindicated rotational shaft opening of the second driven gear 675 with the upper-lower direction as the axial direction. The lower end of the rotational shaft 602C is mounted on the upper face of the second frame 602. The second driven gear 675 is rotatably mounted on the rotational shaft 602C.

With this, the second driven gear 675 is configured to be meshed with the driving gear 663 of the first driving source 66.

The elastic member 677 is provided to an axial-direction intermediate portion of the rotational shaft 601A that functions as the rotational axis center of the second driving lever 674 such that it is interposed between the upper plate and the lower plate of the rotating portion 674A. As the elastic member 677, a torsion coil spring is employed, as with the elastic member 657. One end portion of the elastic member 677 is engaged with the first frame 601, and the other end portion thereof is engaged with the second driving lever 674. The elastic member 677 applies force at all times in a direction such that it causes the second driving lever 674 to rotate in a counterclockwise direction.

(4) Configuration of Second Slide Guide 630

As shown in FIGS. 2, 3A through 3C, 4, and 5, a second slide guide 630 is provided to a right-side end portion of the first slide guide 651. The second slide guide 630 is arranged at a position so as to cover the thread capture member main body 620 of the second thread capture member 62 and the cutting member 63 positioned on the rear face side. The second slide guide 630 is configured including an upper plate and two longitudinal plates (not indicated by reference symbols). The upper plate is configured in an approximately rectangular shape in a plan view with the upper-lower direction as its thickness direction. The two longitudinal plates are monolithically configured with the upper plate such that they form a single unit or they function as a single unit. Furthermore, the two longitudinal plates are configured such that they protrude downward from the lower face of the upper plate and such that they extend in the front-rear direction along both the right side and the left side of the thread capture member main body 620 of the second thread capture member 62.

A plate-shaped mounting portion 630A is provided to a left-side end portion of the upper plate with the upper-lower direction as its thickness direction such that they form a signal unit. Furthermore, a mounting opening (not indicated by a reference symbol) configured as an upper-lower direction through hole is formed in the mounting portion 630A. The second slide guide 630 is coupled to the first slide guide 651 by a coupling member 631 in a state in which the coupling member 631 is inserted into the mounting opening of the mounting portion 630A. As the coupling member 631, a small screw, other screw, or bolt is employed, for example.

The second slide guide 630 is configured to guide the reciprocal movement of the second thread capture member 62 in the front-rear direction. Furthermore, the second slide guide 630 is configured to cover the cutting member 63, thereby providing safety in the sewing operation for the sewing machine user, for example.

It should be noted that the second slide guide 630 is also configured to cover a thread capture member main body 641 of a thread length adjustment mechanism 64 described later. That is, the second slide guide 630 is also configured to guide the reciprocal movement of the third thread capture member 640 in the front-rear direction.

(5) Configuration of Cutting Member 63

As shown in FIG. 4, the cutting member 63 is mounted on an intermediate portion between the right side end of the first slide guide 651 and the guide groove 672 such that it extends along the extending direction of the guide groove 672. The mounting position of the cutting member 63 in the height direction is designed to be positioned between the hole 31 of the needle plate 3 and the rotating hook 5 shown in FIG. 5.

Furthermore, the cutting member 63 is configured to be arranged in an inner-side space defined by a reverse-U-shaped cross-section of the thread capture member main body 620. This arrangement allows the cutting member 63 to cut the lower thread S1 and the upper thread S2 captured by the thread capture portion 621 of the second thread capture member 62 during the returning movement of the second thread capture member 62 in cooperation with the second thread capture member 62. It should be noted that the cutting member 63 is detachably mounted.

(6) Configuration of Thread Length Adjustment Mechanism 64

As shown in FIGS. 2, 3A through 3C, 4, and 5, the thread length adjustment mechanism 64 includes, as its main components, a third thread capture member 640, a third driving mechanism 68, and a second driving source 69.

The third thread capture member 640 includes a thread capture member main body 641 arranged such that it extends with the front-rear direction as its longitudinal direction. The thread capture member main body 641 is provided to a right-side portion of the thread capture member main body 620 of the second thread capture member 62 in the left-right direction such that it is positioned between the thread capture member main body 620 or the cutting member 63 and the hole 31 of the needle plate 3 as viewed from the sewing machine user side. In the present embodiment, the thread capture member main body 641 is arranged in parallel with the thread capture member main body 620 with an appropriate clearance between them. The trajectory of the reciprocal movement of the thread capture main body 641 is designed to be in parallel with the trajectory of the reciprocal movement of the thread capture member main body 620. The cross-sectional structure of the thread capture member main body 641 is not restricted in particular. In this example, the thread capture member main body 641 is formed to have a hollow rectangular cross-sectional structure, supposing it to be cut by a plane that is in parallel with the X-Z axial plane. A pin 643 is provided to the rear-side upper face of the thread capture member main body 641 such that it protrudes upward.

As shown in FIGS. 4 and 5, an adjustment blade portion 642 that functions as a thread capture portion is provided to a front face side end portion of the thread capture member main body 641 such that they form a single unit or function as a single unit. The adjustment blade portion 642 is arranged between the hole 31 of the needle plate 3 and the cutting member 63. The adjustment blade portion 642 is formed to have a hook shape such that a front face side end portion that protrudes from the thread capture member main body 641 is bent toward the lower-rear side.

Figure 10:
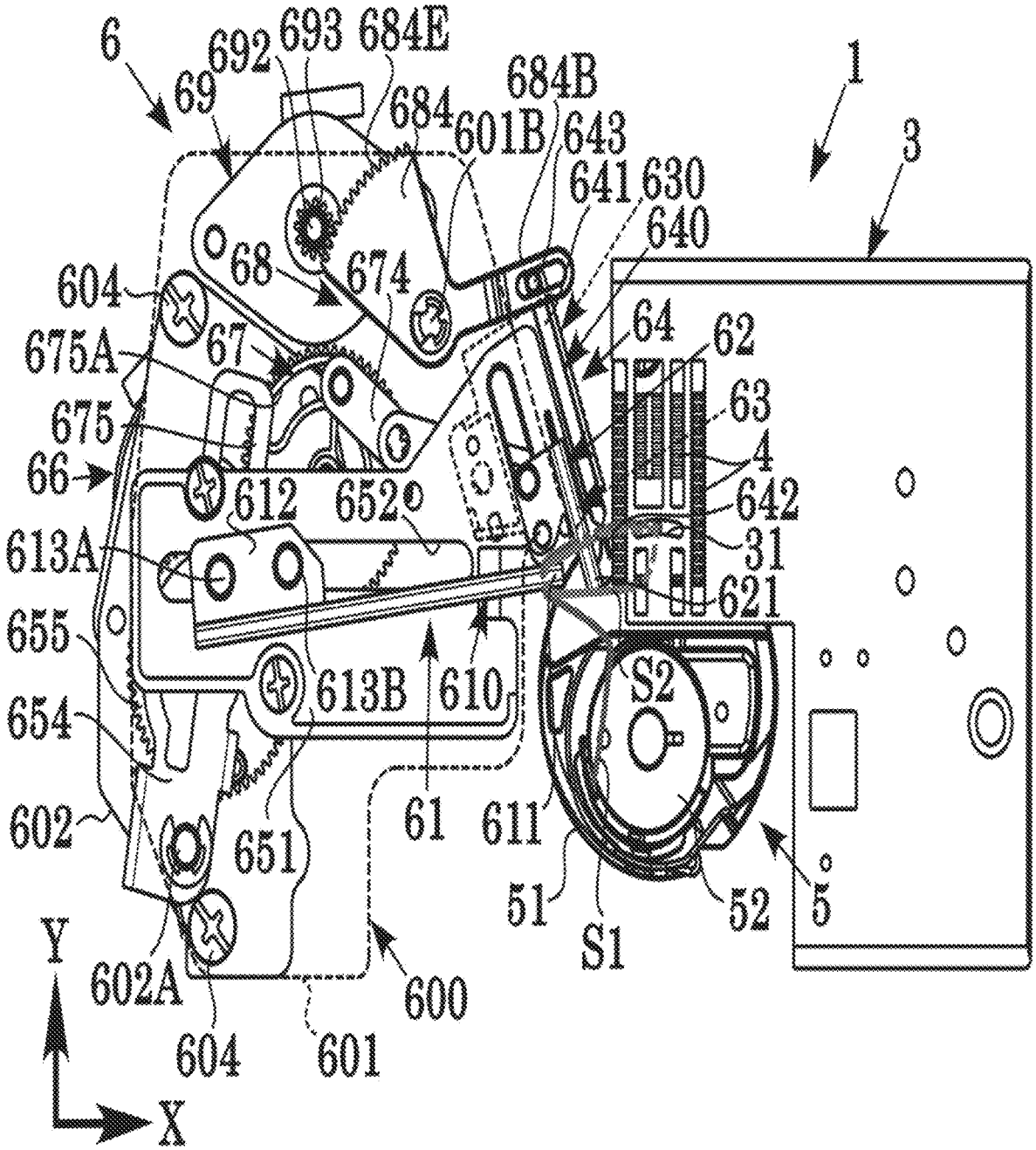
FIG. 10 is a plan view showing the thread cutting apparatus and a part of components of the sewing machine in a sixth step that corresponds to FIG. 5.
Figure 11:
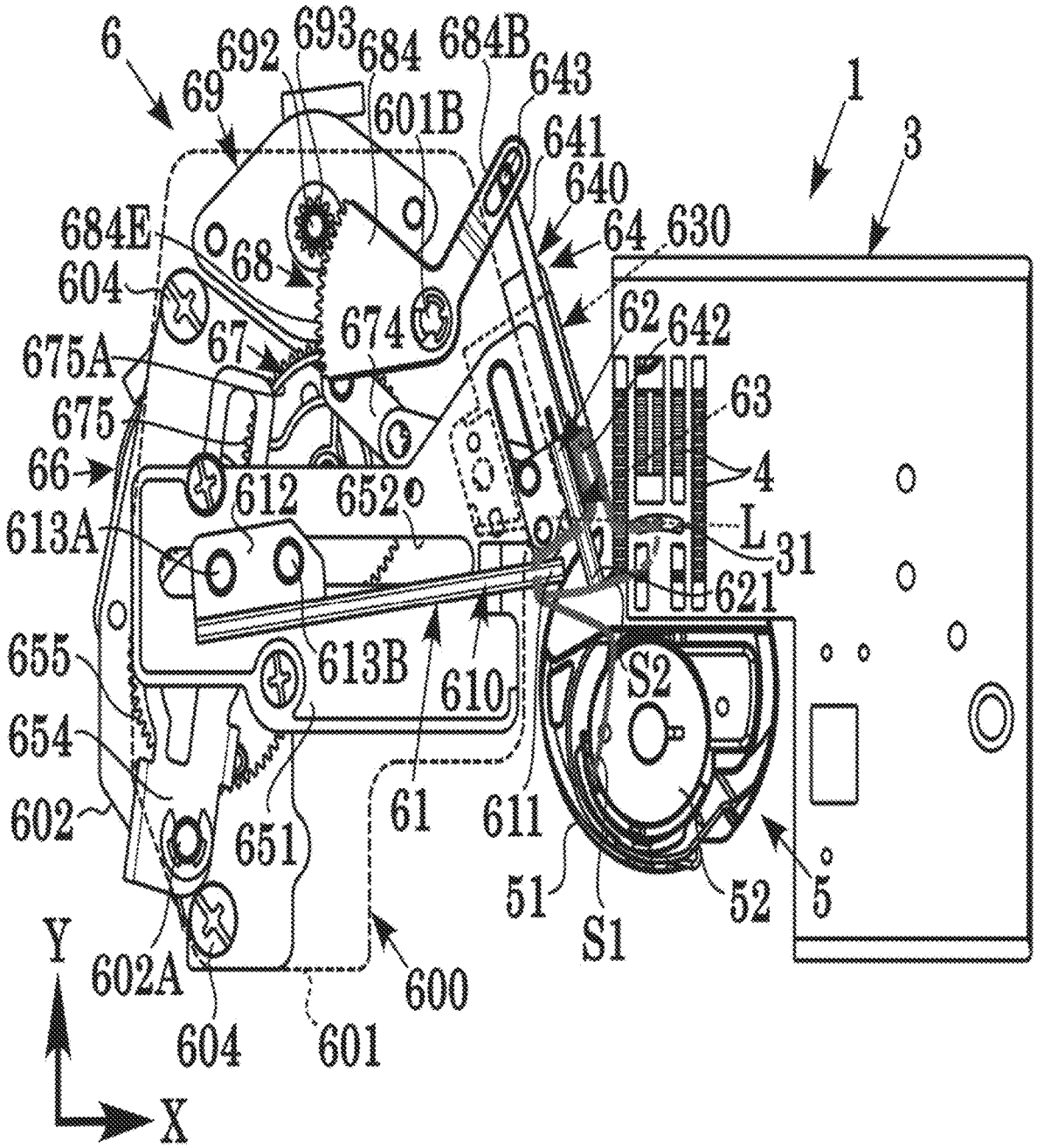
FIG. 11 is a plan view showing the thread cutting apparatus and a part of components of the sewing machine in a seventh step that corresponds to FIG. 5.

The adjustment blade portion 642 is reciprocally moved in the front-rear direction which is the arrow C direction (see FIG. 4) between the hole 31 of the needle plate 3 and the rotating hook 5 shown in FIG. 5, so as to hook and capture the upper thread S2 and the lower thread S1 as shown in FIG. 10. With this arrangement, as shown in FIG. 11, the adjustment blade portion 642 is configured to draw the upper thread S2 and the lower thread S1 from the front face side to the rear face side.

More specifically, before the thread cutting operation, the adjustment blade portion 642 captures and draws the upper thread S2 and the lower thread S1 in a direction that crosses a virtual line L (see FIGS. 11 through 13) that connects the hole 31 of the needle plate 3 and the cutting member 63. In this example, the adjustment blade portion 642 captures and draws the upper thread S2 and the lower thread S1 in the horizontal direction toward the rear face side where there is a vacant space. In a case in which there is such a vacant space, the upper thread S2 and the lower thread S1 may be captured and drawn in a corresponding direction such as a downward direction, a diagonally downward and frontward direction, or a diagonally downward and rearward direction. By drawing the upper thread S2 and the lower thread S1, this arrangement allows the thread margin to be adjusted to a desired length for each of the upper thread S2 and the lower thread S1 remaining on an unshown cloth side to be sewn. That is, the margin length of each of the upper thread S2 and the lower thread S1 to be set for the cloth side to be sewn is not limited to a single fixed margin length, but can be adjusted to a desired one from among multiple (two or more) lengths according to the amount of movement of the adjustment blade portion 642.

For example, the thread length adjustment mechanism 64 is capable of adjusting the thread margin for each of the upper thread S2 and the lower thread S1 in increments of predetermined unit lengths such as 10 mm, 15 mm, 20 mm, or the like (in this example, a unit length of 5 mm is employed).

Also, the thread length adjustment mechanism 64 may be configured to adjust the thread margin to a desired length in a range between 10 mm and 30 mm, for example. For example, such an arrangement allows the thread margin to be adjusted to a desired length such as 12 mm, 15 mm, 17 mm, etc.

As shown in FIG. 4, the thread capture member main body 641 of the third thread capture member 640 is coupled to the third driving mechanism 68. The third thread capture member 640 is configured to be reciprocally moved using the third driving mechanism 68. The third driving mechanism 68 is coupled to the second driving source 69. The driving force of the second driving source 69 is transmitted via the third driving mechanism 68 so as to reciprocally move the third thread capture member 640. The third driving mechanism 68 includes a third driving lever 684 as a main component thereof.

As shown in FIGS. 2, 3A, 4, and 5, the third driving lever 684 is configured including a rotating portion 684A, a lever portion 684B, and an extending portion 684D.

An unindicated rotational shaft opening is provided to the rotating portion 684A such that it passes through in the upper-lower direction. A rotational shaft 601B is inserted into the rotational shaft opening in a state in which it is arranged on the upper face of the first frame 601 with the upper-lower direction as its axial direction. The rotating portion 684A is rotatably mounted on the rotational shaft 601B.

The lever portion 684B is monolithically formed in the rotating portion 684A such that they form a single unit or they function as a single unit, such that it extends toward the rear face side, and such that it has a plate shape with the upper-lower direction as its thickness direction. The lever portion 684B is formed to have an extending-direction intermediate portion having an upwardly stepped structure. The lever portion 684B is configured such that its extending-direction end portion is slid in a state in which it is overlaid on the upper face of the thread capture member main body 641 of the third thread capture member 640. A guide groove 684C is provided to the extending-direction end portion of the lever portion 684B such that it passes through in the upper-lower direction with the extending direction as its groove-length direction. A pin 634 is inserted into the guide groove 684C in a state in which it protrudes toward the rear face side of the thread capture member main body 641.

The extending portion 684D is formed in the rotating portion 684A such that they form a single unit or they function as a single unit and such that it extends toward the left side in the left-right direction. The extending portion 684D is configured in the form of a fan shape in a plan view with the upper-lower direction as its thickness direction such that it widens as it becomes closer to the left side from the rotating portion 684A. A toothed portion 684E is formed in an arc portion of the fan-shaped extending portion 684D.

The second driving source 69 is arranged on the lower face of the first frame 601. The second driving source 69 is mounted as a separate driving source that differs from the first driving source 66. For example, the second driving source 69 is configured including a stepping motor 691 as with the first driving source 66.

The stepping motor 691 is fixedly mounted on the first frame 601 with the upper-lower direction as the axial direction of a rotational shaft 692 thereof. A driving gear 693 is mounted on the rotational shaft 692. The rotational shaft 692 and the driving gear 693 are arranged such that they protrude toward the front face side of the first frame 601 via the coupling opening 601C formed such that it passes through the first frame 601. The driving gear 693 is configured such that it meshes with the toothed portion 684E formed in the extending portion 684D of the third driving lever 684.

The stepping motor 691 is directly connected to the control unit 27, or connected to the control unit 27 via an unshown motor driver, as with the stepping motor 661. The rotation of the stepping motor 691 is controlled according to an instruction from the control unit 27. Furthermore, the control unit 27 is interconnected to the operating unit 27, the display unit 25, and the like, via the common bus.

(7) Configuration of Guide Portion 43

Figure 12:
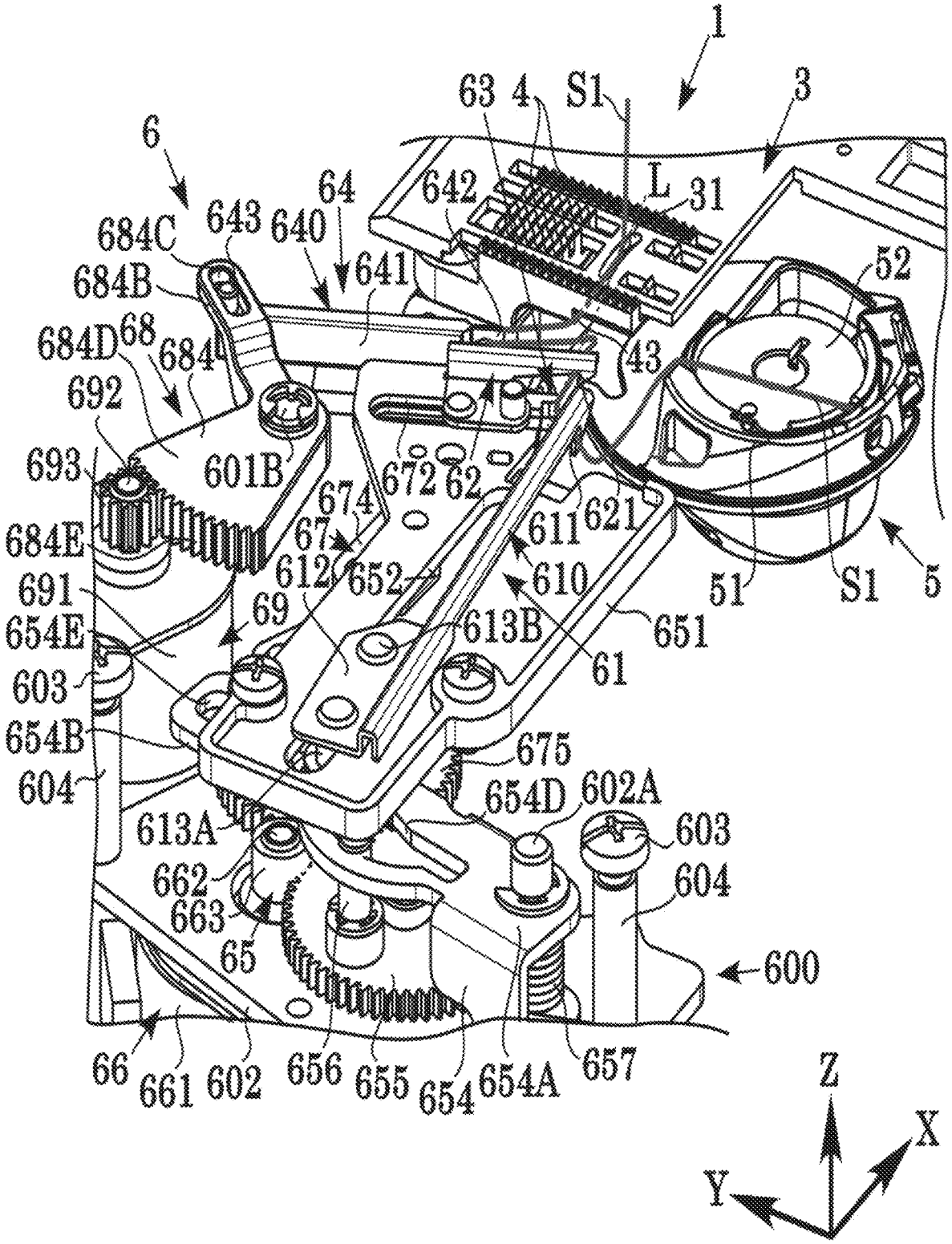
FIG. 12 is a perspective view showing the thread cutting apparatus and a part of components of the sewing machine in the seventh step.
Figure 13:
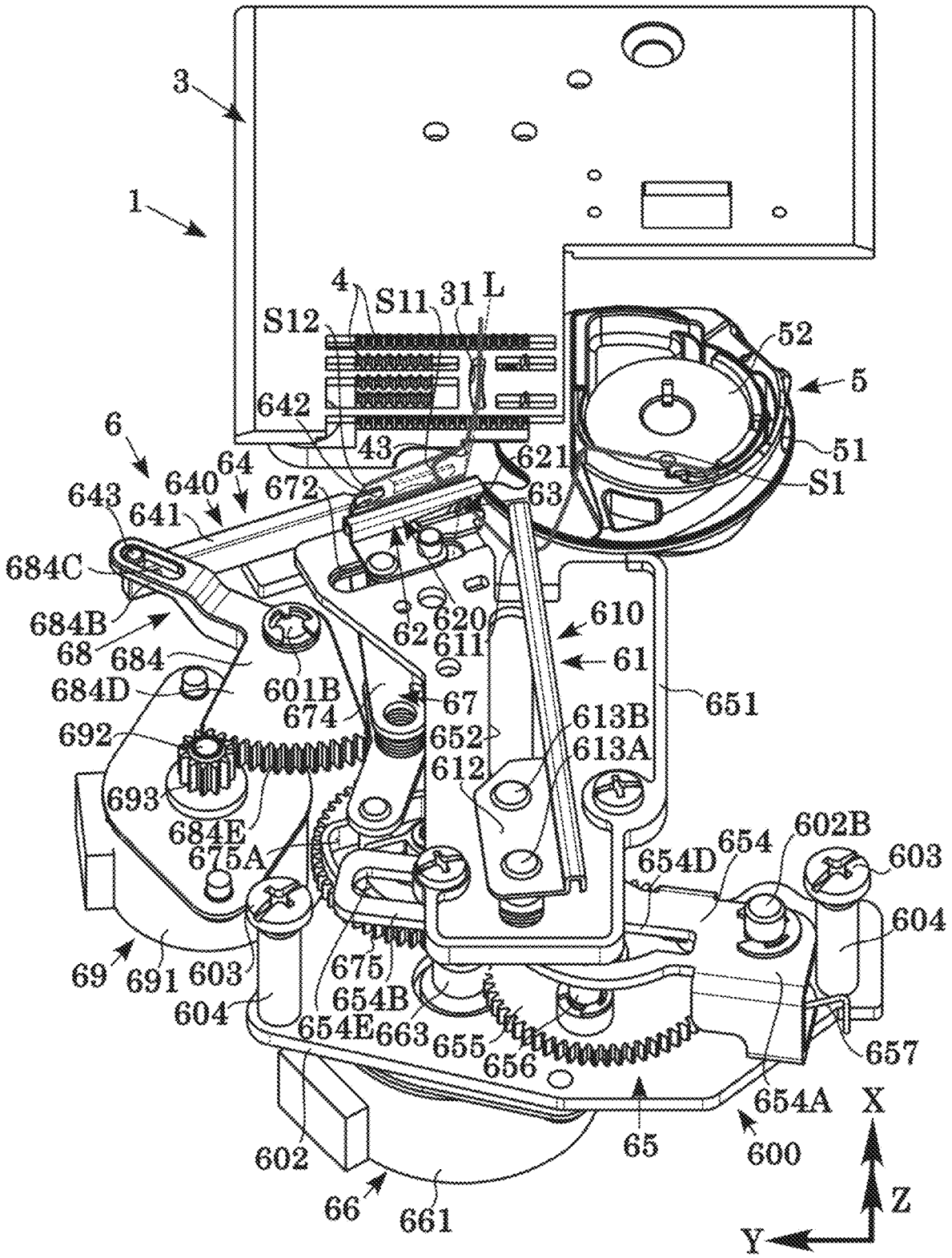
FIG. 13 is a perspective view showing the thread cutting apparatus and a part of components of the sewing machine in the seventh step as viewed from an angle that differs from that in FIG. 12.
Figure 14A:
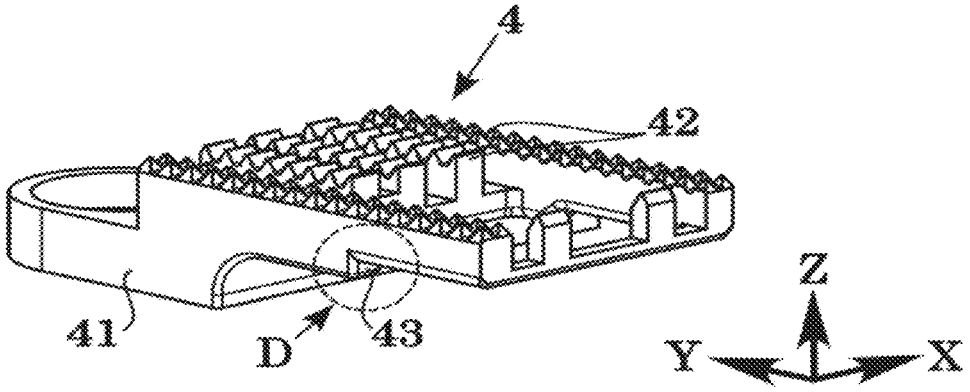
FIG. 14A is an enlarged perspective view showing a guide portion of the thread cutting apparatus shown in FIGS. 12 and 13.
Figure 14B:
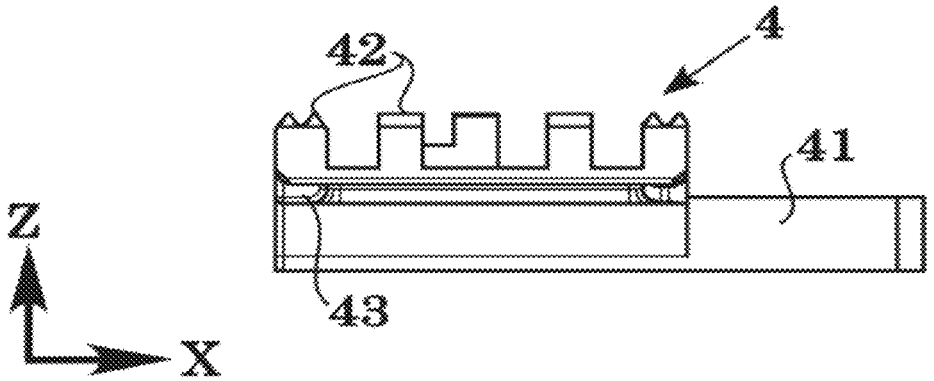
FIG. 14B is an enlarged front view showing the guide portion shown in FIG. 14A as viewed from the Y-axis direction.
Figure 14C:
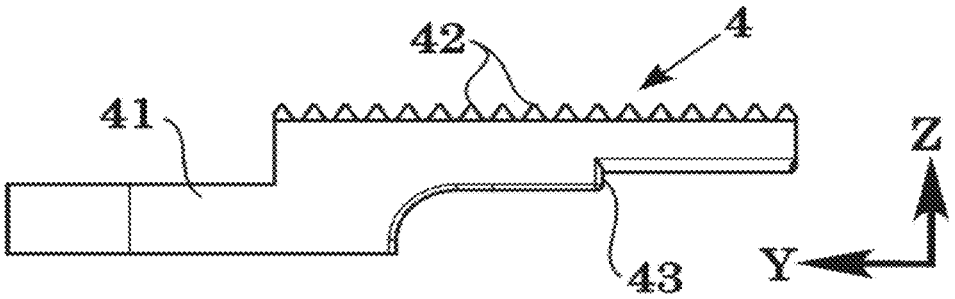
FIG. 14C is an enlarged side view showing the guide portion shown in FIG. 14A as viewed from the X-axis direction.
Figure 14D:
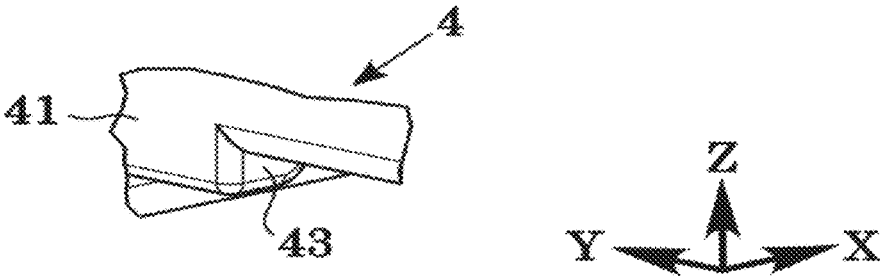
FIG. 14D is an enlarged principal-component perspective view showing a further enlarged view of the guide portion denoted by reference symbol "D" in FIG. 14A.
Figure 15A:
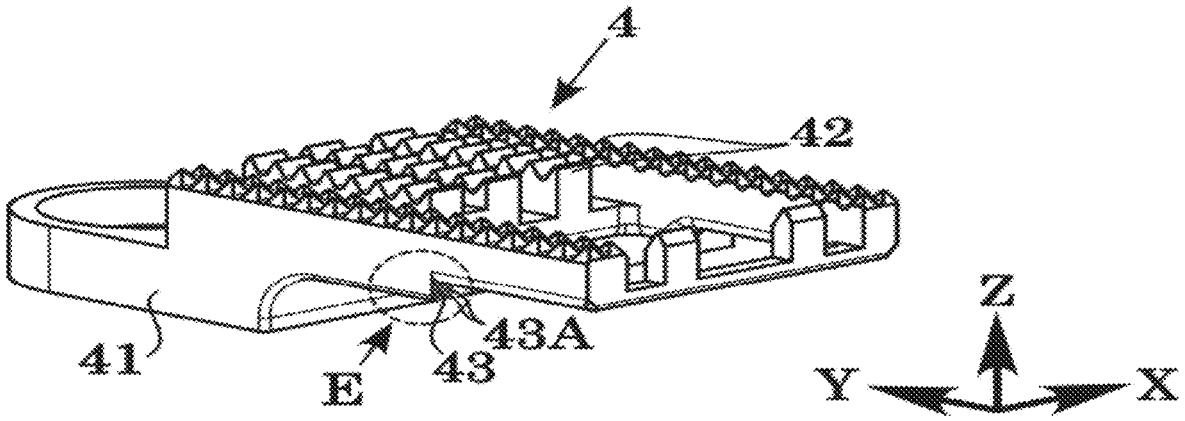
FIG. 15A is an enlarged perspective view showing the guide portion of the thread cutting apparatus included in the sewing machine according to a first modification of the first embodiment.
Figure 15B:
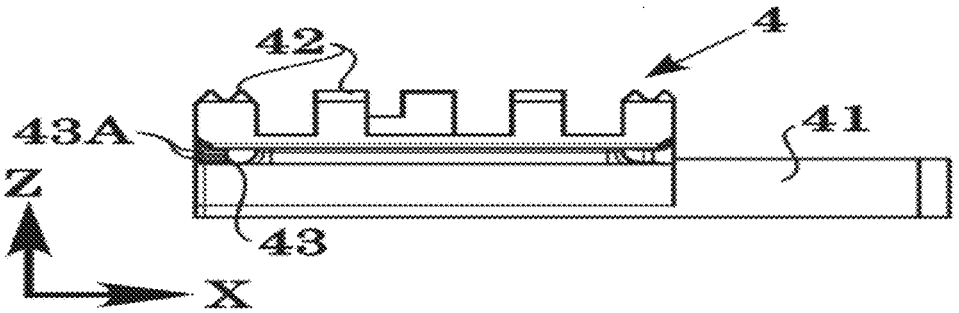
FIG. 15B is an enlarged front view showing the guide portion shown in FIG. 15A as viewed from the Y-axis direction.
Figure 15C:
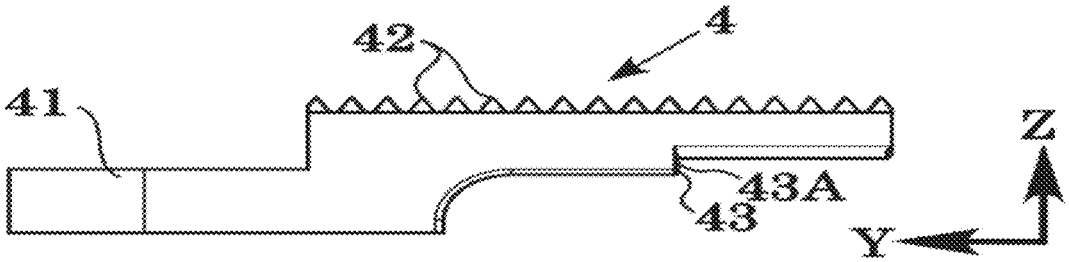
FIG. 15C is an enlarged side view showing the guide portion shown in FIG. 15A as viewed from the X-axis direction.
Figure 15D:
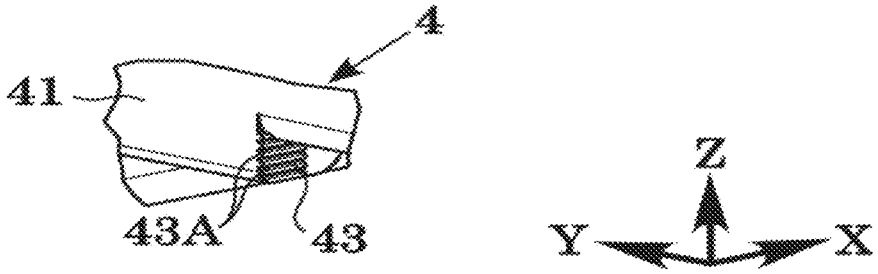
FIG. 15D is an enlarged principal-component perspective view showing a further enlarged view of the guide portion denoted by the reference symbol "E" in FIG. 15A.
Figure 16A:
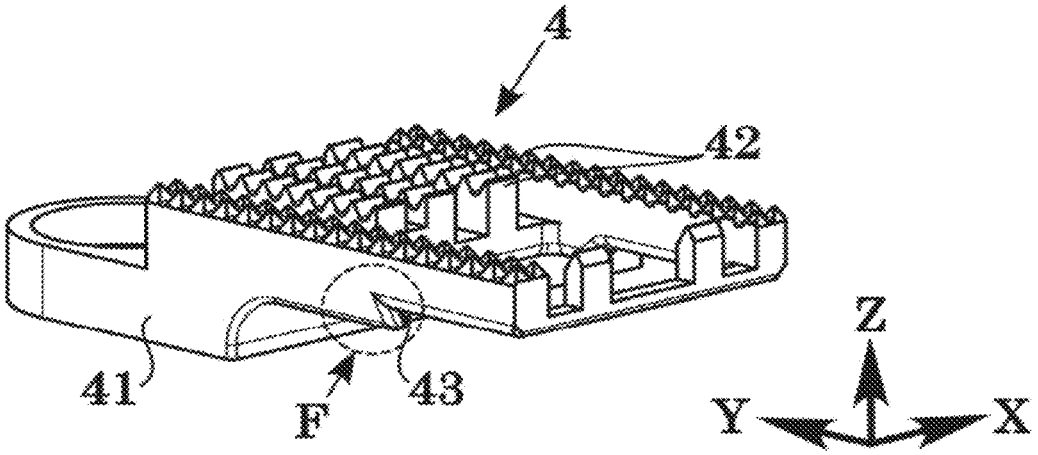
FIG. 16A is an enlarged perspective view showing the guide portion of the thread cutting apparatus included in the sewing machine according to a second modification of the first embodiment.
Figure 16B:
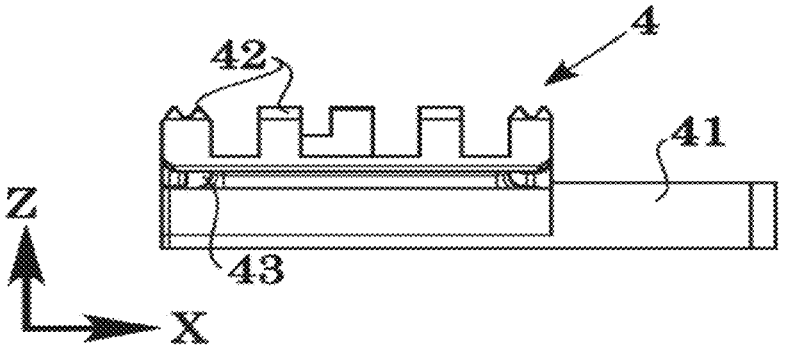
FIG. 16B is an enlarged front view showing the guide portion shown in FIG. 16A as viewed from the Y-axis direction.
Figure 16C:
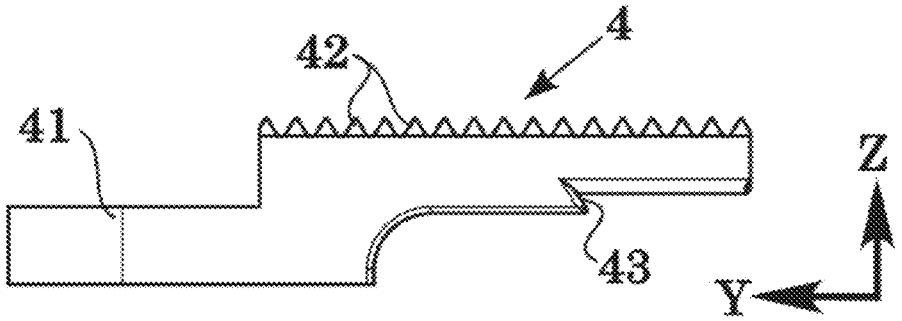
FIG. 16C is an enlarged side view showing the guide portion shown in FIG. 16A as viewed from the X-axis direction.
Figure 16D:
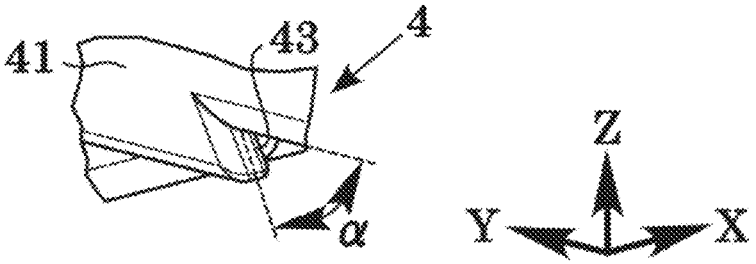
FIG. 16D is an enlarged principal-component perspective view showing a further enlarged view of the guide portion denoted by the reference symbol "F" in FIG. 16A.

The sewing machine 1 according to the present embodiment includes a guide portion 43 configured to guide the upper thread S2 and the lower thread S1 when the thread length adjustment mechanism 64 adjusts the length of each of the upper thread S2 and the lower thread S1, as shown in FIGS. 12 and 13. Detailed description thereof will be made.

In the present embodiment, as shown in FIG. 14A through 14D, the guide portion 43 is provided to the feed dog 4 at a position between the hole 31 of the needle plate 3 and the adjustment blade portion 642 of the thread length adjustment mechanism 64. The feed dog 4 is configured including a feed dog main body 41 and a toothed portion 42 provided to the upper face of the feed dog main body 41. The guide portion 43 is configured as a stepped portion formed in a lower portion of the feed dog main body 41 such that it is positioned on the left side of a front-rear direction intermediate portion of the feed dog main body 41. The stepped portion is formed at a boundary position between the front face side and the rear face side such that the rear-side lower face of the feed dog main body 41 is formed as a lower portion as compared with the front-side lower face of the feed dog main body 41. In this example, the stepped portion is designed to have a vertical face.

As shown in FIGS. 12 and 13, the guide portion 43 is capable of hooking and guiding the upper thread S2 and the lower thread S1 when the upper thread S2 and the lower thread S1 are captured and returned by the adjustment blade portion 642.

(Thread Cutting Method Including Thread Length Adjustment Method)

Description will be made with reference to FIGS. 5 through 12 in addition to FIGS. 2 through 4 regarding a thread cutting method and thread length adjustment method employed in the thread cutting apparatus 6 included in the sewing machine 1 according to the present embodiment.

(1) Thread Cutting Method without Using Thread Length Adjustment Mechanism 64

First, description will be made regarding an ordinary thread cutting method employed in the thread cutting apparatus 6 without using the thread length adjustment mechanism 64. As shown in FIG. 5, before cutting the upper thread S2 and the lower thread S1, the thread cutting apparatus 6 is in a state in which the first thread capture member 61, the second thread capture member 62, and the third thread capture member 640 of the thread length adjustment mechanism 64 are set to a home position.

That is, the first thread capture member 61 is set to a state in which the first pin 613A of the slide portion 612 shown in FIG. 4 is positioned in a base-end groove 652A formed in a left-side portion of the guide groove 652 defined in the left-right direction and the base-end groove 653A of the guide groove 653. In this state, the second pin 613B is positioned on the leftmost side of the capture groove 652C and the capture groove 653C. With this, the slide portion 612 is positioned at the left end of the guide grooves 652 and 653. In this state, the thread capture member main body 610 and the thread capture portion 611 of the first thread capture member 61 are positioned on the left side.

Furthermore, the second thread capture member 62 is set to a state in which the first pin 623A of the slide portion 622 is positioned on the rear-face side of the guide grooves 672 and 673, and the second pin 623B is positioned on the rear-face side of the guide grooves 672 and 673. With this, the slide portion 622 is positioned on the rear-face end of the guide grooves 672 and 673. In this state, the thread capture member main body 620 and the thread capture portion 621 of the second thread capture member 62 are positioned on the rear-face side.

The third thread capture member 640 is set to a state in which the lever portion 684B of the third driving lever 684 of the third driving mechanism 68 is positioned at the rear-face end. The guide groove 684C of the lever portion 684B is coupled to the pin 634 arranged on the rear-face side of the thread capture member main body 641 of the third thread capture member 640. Accordingly, the thread capture member main body 641 and the adjustment blade portion 642 are positioned on the rear-face side.

As shown in FIG. 6, the first thread capture member 61 is advanced to the rightmost end position, which moves the thread capture portion 611 of the first thread capture member 61 to the rightmost end position, so as to start to capture the upper thread S2 (not shown) and the lower thread S1. In this stage, the second thread capture member 62 is advanced up to a position at which the upper thread S2 and the lower thread S1 can be captured.

As shown in FIG. 4, the first thread capture member 61 is moved by the first driving source 66 via the first driving mechanism 65. More specifically, the first pin 613A and the second pin 613B provided to the slide portion 612 of the first thread capture member 61 are moved in the left-right direction along the guide groove 652 formed in the first slide guide 651 and the guide groove 653 formed in the first frame 601. The first pin 613A is coupled to a driven groove 654E formed in the first driving lever 654. With this, the first driving lever 654 is rotated with the rotating portion 654A as the center of rotation, thereby transmitting the driving force to the first thread capture member 61. The driving pin 656 attached to the first driven gear 655 is inserted into the driving groove 654D of the first driving lever 654. By rotating the first driven gear 655, the driving force is transmitted to the first driving lever 654 via the driving pin 656. The first driven gear 655 is arranged such that it meshes with the driving gear 663 mounted on the rotational shaft 662 of the stepping motor 661 of the first driving source 66. This allows the rotational force of the first driving source 66 to be transmitted to the first driven gear 655. When the thread cutting operation is executed by the operating unit 24, the first driving source 66 is controlled via the control unit 27.

On the other hand, the second thread capture member 62 is moved by the first driving source 66 via the second driving mechanism 67 in cooperation with (in synchronization with) the first capture member 61. More specifically, the first pin 623A and the second pin 623B provided to the first slide guide portion 622 of the second thread capture member are moved in the front-rear direction along the guide groove 672 formed in the first slide guide 651 and the guide groove 673 formed in the first frame 601. The first pin 623A is coupled to the driving groove 674E of the second driving lever 674. By rotating the second driving lever 674 with the rotating portion 674A as the center of rotation, the driving force is transmitted to the second thread capture member 62. The driven pin 676 is attached to the extending portion 674D of the second driving lever 674. The driven pin 676 is inserted into the guide portion 675A of the second driven gear 675. That is, upon rotating the second driven gear 675, the driven pin 676 guided along the guide portion 675A is moved, which transmits the driving force to the second driving lever 674. The second driven gear 675 is arranged such that it meshes with the driving gear 663 of the first driving source 66. With this, the rotational force of the first driving source 66 is transmitted to the second driven gear 675.

As shown in FIG. 7, the thread capture portion 611 of the first thread capture member 61 is returned from the right-most side to the capture position defined on the left side. At an intermediate timing when the thread capture portion 611 passes through the inner hook 51 of the rotating hook 5, the thread capture portion 611 captures the upper thread S2. In this stage, the thread capture portion 611 also captures the lower thread S1.

As shown in FIG. 8, the thread capture portion 611 of the first thread capture member 61 is further returned from the capture position to the left side. By executing this returning movement, the first pin 613A shown in FIG. 4 is moved from the right side to the left side along the capture groove 652C, the swing groove 652B, and the base-end groove 652A of the guide groove 652. Furthermore, the first pin 613A is moved from the right side to the left side along the capture groove 653C, the swing groove 653B, and the base-end groove 653A of the guide groove 653. On the other hand, the second pin 613B is moved from the right side to the left side along the capture groove 652C of the guide groove 652 and the capture groove 653C of the guide groove 653.

With the slide portion 612, the first pin 613A is moved toward the front face side with the second pin 613B as the center of rotation. Accordingly, the thread capture member main body 610 is rotated in a counterclockwise manner, which swings the thread capture portion 611 toward the second thread capture member 62 side. By swinging the thread capture portion 611, this arrangement allows the thread capture portion 621 of the second thread capture member 62 to capture the upper thread S2 and the lower thread S1.

Figure 9:
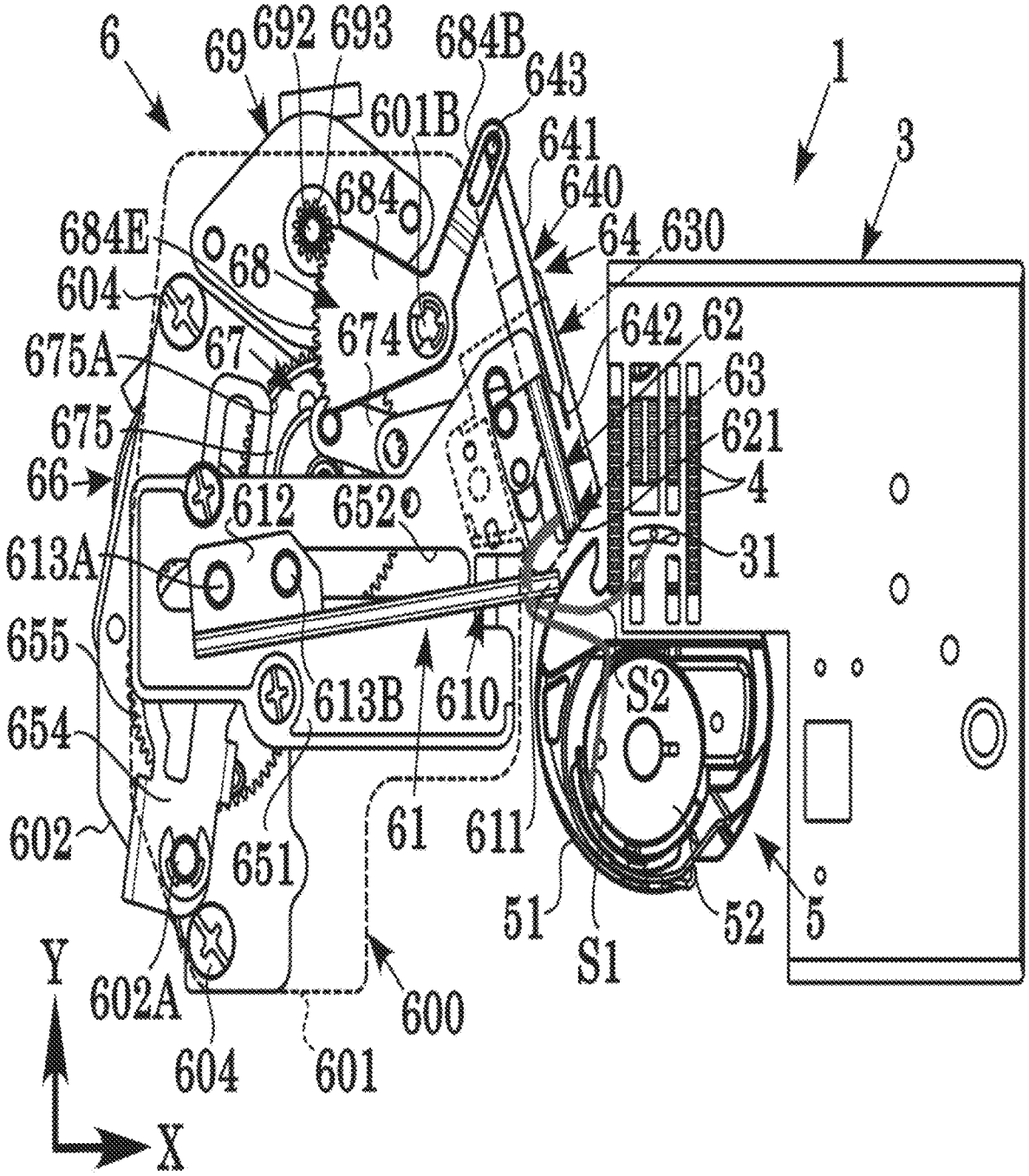
FIG. 9 is a plan view showing the thread cutting apparatus and a part of components of the sewing machine in a fifth step that corresponds to FIG. 5.

As shown in FIG. 9, the second thread capture member 62 starts its returning movement in a state in which the thread capture portion 611 of the first thread capture member 61 and the thread capture portion 621 of the second thread capture member 62 capture the upper thread S2 and the lower thread S1. By executing the returning movement, the thread capture member main body 620 and the thread capture portion 621 of the second thread capture member 62 are moved from the front face side to the rear face side. In this stage, the second thread capture member 62 and the cutting member 63 cut the upper thread S2 and the lower thread S1 in cooperation with each other. That is, the upper thread S2 and the lower thread S1 captured by the thread capture portion 621 are transferred to the cutting edge of the cutting member 63. When the upper thread S2 and the lower thread S1 cross the edge, they are cut.

Subsequently, the first thread capture member 61 and the second thread capture member 62 are returned to the home position described above with reference to FIG. 5, and the thread cutting method employed in the thread cutting apparatus 6 ends.

With the thread cutting method shown in FIGS. 5 through 9, the length between the hole 31 of the needle plate 3 and the cutting member 63 is fixed. Accordingly, the thread margin (length) of each of the upper thread S2 and the lower thread S1 remaining on an unshown cloth side to be sewn is set to the shortest length, e.g., 10 mm.

(2) Thread Adjustment Method Using Thread Length Adjustment Apparatus 64

Next, description will be made regarding a thread length adjustment method using the thread length adjustment mechanism 64 provided to the thread cutting apparatus 6. First, before operating the thread cutting apparatus 6, in the operating unit 24 shown in FIGS. 1 and 2, the thread margin remaining on the cloth side to be sewn is set to a desired value. Here, the thread margin is set to 30 mm, for example. The desired value of the thread margin thus set is displayed on the display unit 25 in the form of a numeric value, for example.

Upon operating the thread cutting apparatus 6 via the control unit 27 shown in FIG. 4, in the same way as in the thread cutting method described above with reference to FIGS. 5 through 8, the upper thread S2 and the lower thread S1 are captured by the thread capture portion 611 of the first thread capture member 61 and the thread capture portion 621 of the second thread capture member 62.

The second driving source 69 is driven by the control unit 27 based on the thread margin set by the operating unit 24. The thread length adjustment mechanism 64 is operated by the second driving source 69 via the third driving mechanism 68 (see FIG. 4). More specifically, the driving gear 693 of the second driving source 69 shown in FIGS. 2, 3A, 4, and 10 is rotated in a counterclockwise manner in a plan view, which rotates the third driving lever 684 of the third driving mechanism 68 in a clockwise manner with the rotating portion 684A as the center of rotation. By executing the rotation, as shown in FIG. 10, the lever portion 684B advances the thread capture member main body 641 and the adjustment blade portion 642 of the third thread capture member 640 from the rear face side to the capture position on the frontmost side.

It should be noted that the adjustment blade portion 642 starts the advancing movement at the same timing as the advancing movement of the thread capture portion 621 of the second thread capture member 62. The advancing movement of the adjustment blade portion 642 ends before the start of the returning movement of the thread capture portion 611 of the first thread capture member 61.

As shown in FIGS. 11 through 13, the adjustment blade portion 642 of the third thread capture member 640 is returned until it reaches the thread margin set beforehand in a state in which movement of the first thread capture member 61 and the second thread capture member 62 is suspended. Immediately after the start of the returning movement, the adjustment blade portion 642 captures the upper thread S2 and the lower thread S1 captured by the thread capture portion 611 and the thread capture portion 621. Subsequently, the upper thread S2 and the lower thread S1 thus captured are drawn from the capture position toward the rear face side between the hole 31 of the needle plate 3 and the cutting member 63 by the returning movement of the adjustment blade portion 642 until it reaches the thread margin set beforehand.

In FIGS. 12 and 13, the upper thread S2 is not shown, and only the lower thread S1 is shown. Also, the amount of thread length adjustment provided by the returning movement of the adjustment blade portion 642 is shown for ease of understanding. In FIG. 13, the lower thread S1 before the thread length adjustment mechanism 64 is operated is denoted by the reference symbol S11. The lower thread S1 after the thread length adjustment mechanism 64 is operated is denoted by the reference symbol S12.

As shown in FIGS. 12, 13, and 14A through 14D, the adjustment of the thread margin employing the thread length adjustment mechanism 64 also employs the guide portion 43 provided to the lower portion of the feed dog 4 arranged between the hole 31 of the needle plate 3 and the adjustment blade portion 642. The guide portion 43 guides the upper thread S2 and the lower thread S1 in a state in which they are maintained at the same position as the hole 31 of the needle plate 31 in the front-rear direction when the adjustment blade portion 642 captures and returns the upper thread S2 and the lower thread S1 returns toward the rear face side. With this, the thread feed path that connects the hole 31, the guide portion 43, and the adjustment blade portion 642 is long as compared with the thread feed path that directly connects the hole 31 and the adjustment blade portion 642. That is, in a case in which the same thread margin is to be provided, by providing such a guide portion 43, this arrangement allows the movement amount necessary for the adjustment blade portion 642 to be reduced.

Subsequently, the second thread capture member 62 starts its returning movement (see FIG. 9). In this state, the thread capture portion 611 of the first thread capture member 61 and the thread capture portion 621 of the second thread capture member 62 capture the upper thread S2 and the lower thread S1. Furthermore, in this state, the adjustment blade portion 642 of the thread length adjustment mechanism 64 captures the upper thread S2 and the lower thread S1 in a state in which it adjusts the thread margin. The second thread capture member 62 performs its returning movement, thereby moving the thread capture member main body 620 and the thread capture portion 621 of the second thread capture member 62 from the front face side toward the rear face side. In this stage, the second thread capture member 62 and the cutting member 63 cut the upper thread S2 and the lower thread S1 in cooperation with each other. That is, the thread margin of each of the upper thread S2 and the lower thread S1 remaining on the cloth side to be sewn is adjusted by the thread length adjustment mechanism 64.

Subsequently, the first thread capture member 61, the second thread capture member 62, and the third thread capture member 640 of the thread length adjustment mechanism are returned to the home position described above with reference to FIG. 5, whereby the thread length adjustment method employed in the thread cutting apparatus 6 ends.

As described above, with the thread length adjustment method using the thread length adjustment mechanism 64 provided to the thread cutting apparatus 6, the thread margin of each of the upper thread S2 and the lower thread S1 defined between the hole 31 of the needle plate 3 and the cutting member 63 is adjusted to a desired value by the returning movement of the adjustment blade portion 642. Specifically, the thread margin of each of the upper thread S2 and the lower thread S1 remaining on the cloth side to be sewn is adjusted to a desired amount, e.g., 30 mm, according to a setting value set beforehand via the operating unit 24.

[Operation and Effects]

As shown in FIGS. 2, 3A through 3C, 4, and 5, the sewing machine 1 shown in FIG. 1 according to the present embodiment includes the thread cutting apparatus 6. The thread cutting apparatus 6 is configured including the cutting member 63 and the thread length adjustment mechanism 64. The cutting member 63 cuts the upper thread S2 and the lower thread S1 arranged between the hole 31 of the needle plate 3 and the rotating hook 5. The thread length adjustment mechanism 64 adjusts the length of each of the upper thread S2 and the lower thread S1 from the hole 31 of the needle plate 3 up to the cutting member 63.

With this, the thread length adjustment mechanism 64 is capable of adjusting the length of each of the upper thread S2 and the lower thread S1 remaining on the cloth side to be sewn from the hole 31 of the needle plate 3 up to the cutting member 63. This allows the thread margin remaining on the cloth side to be sewn to be adjusted as desired.

Furthermore, in the sewing machine 1 according to the present embodiment, the thread length adjustment mechanism 64 includes the adjustment blade portion 642 as shown in FIGS. 4 and 10 through 13 in particular. The adjustment blade portion 642 is arranged between the hole 31 of the needle plate 3 and the cutting member 63. The adjustment blade portion 642 is configured to be moved in a state in which it captures the upper thread S2 and the lower thread S1.

With this, the upper thread S2 and the lower thread S1 are captured by the adjustment blade portion 642. In this state, the adjustment blade portion 642 is moved. This allows the thread margin to be adjusted to a desired value in a simple manner.

Furthermore, as shown in FIGS. 12, 13, and 14A through 14D, the sewing machine 1 according to the present embodiment includes the guide portion 43. The guide portion 43 is provided between the hole 31 of the needle plate 3 and the adjustment blade portion 642. When the adjustment blade portion 642 is moved, the guide portion 43 guides the upper thread S2 and the lower thread S1.

With this, the thread feed path defined by the hole 31 of the needle plate 3, the guide portion 43, and the adjustment blade portion 642 can be changed as compared with the thread feed path that directly connects the hole 31 of the needle plate 3 and the adjustment blade portion 642. The length of the latter thread feed path is set to a large value as compared with the former thread feed path. Accordingly, the same thread margin provided by the former thread feed path can be provided by the latter thread feed path with only a small amount of movement of the adjustment blade portion 642. In other words, such an arrangement allows the amount of movement required for the adjustment blade portion 642 to be reduced. This allows the size of the thread length adjustment mechanism 64 to be reduced, thereby allowing the thread cutting apparatus 6 including the thread length adjustment mechanism 64 to be made more compact.

Furthermore, in the sewing machine 1 according to the present embodiment, the thread cutting apparatus 6 includes the first thread capture member 61 and the second thread capture member 62 as shown in FIGS. 4, 12, and 13 in particular. The first thread capture member 61 captures the upper thread S2 and the lower thread S1 between the hole 31 of the needle plate 3 and the rotating hook 5, and is moved relative to the cutting member 63. Similarly, the second thread capture member 62 captures the upper thread S2 and the lower thread S1 between the hole 31 of the needle plate 3 and the rotating hook 5, and is moved relative to the cutting member 63.

The first thread capture member 61 is capable of capturing the upper thread S2 and the lower thread S1 in a sure manner, and of being moved relative to the cutting member 63 so as to pass the upper thread S2 and the lower thread S1 to the second thread capture member 62 in a sure manner. On the other hand, the second thread capture member 62 captures the upper thread S2 and the lower thread S1 thus passed in a sure manner. Subsequently, the second thread capture member 62 is moved relative to the cutting member 63. With this, the second thread capture member 62 and the cutting member 63 cut the upper thread S2 and the lower thread S1 in cooperation with each other. This allows the thread cutting apparatus 6 to perform the thread cutting operation in a sure manner.

It should be noted that, with the sewing machine 1 according to the present embodiment, in a case in which at least the second thread capture member 62 is provided, such an arrangement is capable of capturing the upper thread S2 and the lower thread S1, and of cutting the upper thread S2 and the lower thread S1 in cooperation with the cutting member 63.

Furthermore, as shown in FIG. 4, the sewing machine 1 according to the present embodiment includes the operating unit 24, the second driving source 69, and the control unit 27. The operating unit 24 sets the thread margin of each of the upper thread S2 and the lower thread S1 to be set for the thread length adjustment mechanism 64. The second driving source 69 drives the thread length adjustment mechanism 64. The control unit 27 drives the second driving source 69 based on the thread margin set via the operating unit 24.

With this, the control unit 27 is capable of driving the second driving source 69 based on the thread margin thus set via the operating unit 24, so as to operate the thread length adjustment mechanism 64. This allows the thread margin remaining on the cloth side to be sewn to be automatically adjusted to a desired value.

[First Modification]

Description will be made with reference to FIGS. 15A through 15D regarding a sewing machine 1 according to a first modification of the first embodiment of the present invention. In description of the sewing machine 1 according to the first modification, the guide portion 43 provided to the feed dog 4 has a modified configuration.

It should be noted that, in the first modification, and in a second modification, second embodiment, and third embodiment, described later, the same or substantially the same components will be denoted by the same reference symbols. Also, redundant description thereof will be omitted.

As shown in FIGS. 15A through 15D, in the sewing machine 1 according to the first modification, the guide portion 43 configured as a stepped portion is provided to the lower portion of the feed dog main body 41 of the feed dog 4, as with the sewing machine 1 according to the first embodiment. The guide portion 43 is configured including multiple grooves 43A formed in the vertical face of the stepped portion thereof. The multiple grooves 43A are arranged at regular intervals such that they extend with the left-right direction as the groove length, and with the left-right direction as the groove width. Each groove 43A is formed to have a V-shaped or U-shaped structure having an opening that faces the front side as viewed from the X-axis direction.

The sewing machine 1 according to the first modification has the same components as those of the sewing machine 1 according to the first embodiment except for the guide portion 43 described above.

The sewing machine 1 according to the first modification provides the same operation and effects as those provided by the sewing machine 1 according to the first embodiment.

In the sewing machine 1 according to the first modification, the guide portion 43 is provided with the multiple grooves 43A. More specifically, in the operation for adjusting the thread margin remaining on the cloth side to be sewn to a desired amount by the thread length adjustment mechanism 64, when the adjustment blade portion 642 captures the upper thread S2 and the lower thread S1 so as to draw them from the front face side to the rear face side, the upper thread S2 and the lower thread S1 are each engaged with the grooves 43A.

With this, such an arrangement is capable of effectively suppressing or preventing detachment of the upper thread S2 and the lower thread S1 downward from the guide portion 43.

[Second Modification]

Description will be made with reference to FIGS. 16A through 16D regarding a sewing machine 1 according to a second modification of the first embodiment of the present invention. Specifically, in the description of the sewing machine 1 according to the second modification, description will be made regarding an example of a modified configuration of the guide portion 43 provided to the feed dog 4.

As shown in FIGS. 16A through 16D, in the sewing machine 1 according to the second modification, the guide portion 43 configured as a stepped portion is provided to a lower portion of the feed dog main body 41 of the feed dog 4, as with the sewing machine 1 according to the first embodiment. The guide portion 43 is designed such that the face of its stepped portion has an acute angle $\alpha$ that is smaller than 90 degrees with respect to the front-side lower face of the feed dog main body 41. In other words, the face of the stepped portion of the guide portion 43 is designed as a slope such that the upper thread S2 and the lower thread S1 are moved upward along the slope when they are captured and drawn by the adjustment blade portion 642.

The sewing machine 1 according to the second modification has the same components as those of the sewing machine 1 according to the first embodiment except for the guide portion 43 described above.

The sewing machine 1 according to the second modification provides the same operation and effects as those provided by the sewing machine 1 according to the first embodiment.

In the sewing machine 1 according to the second modification, the guide portion 43 is designed such that the face of its stepped portion has an acute angle α. In the operation for adjusting the thread margin remaining on the cloth side to be sewn to a desired amount by the thread length adjustment mechanism 64, the upper thread S2 and the lower thread S1 are moved upward along the face defined by the stepped portion of the guide portion 43.

With this, such an arrangement is capable of effectively suppressing or preventing detachment of the upper thread S2 and the lower thread S1 downward from the guide portion 43.

Second Embodiment

Description will be made with reference to FIGS. 17 and 18 regarding a sewing machine 1 according to a second embodiment of the present invention, a thread cutting apparatus 6 mounted on the sewing machine 1, and a thread cutting method including a thread length adjustment method.

[Configuration of Thread Cutting Apparatus 6 and Thread Length Adjustment Mechanism 64]

In the sewing machine 1 according to the present embodiment, the third driving mechanism 68 of the thread length adjustment mechanism 64 and the second driving source 69 each have a configuration that differs from that in the thread cutting apparatus 6 of the sewing machine 1 according to the first embodiment. More specifically, as shown in FIG. 17, the thread length adjustment mechanism 64 includes the third thread capture member 640, the third driving mechanism 68, and a second driving source 70.

The third thread capture member 640 of the thread length adjustment mechanism 64 has the same configuration as that of the third thread capture member 640 of the thread length adjustment mechanism 64 of the sewing machine 1 according to the first embodiment. The third thread capture member 640 is configured including the adjustment blade portion 642.

The third driving mechanism 68 includes the third driving lever 684 as its main component. The third driving lever 684 is configured including the rotating portion 684A, the lever portion 684B, and a coupling portion 684F.

The rotating portion 684A has the same configuration as that of the rotating portion 684A according to the first embodiment. A rotational shaft 601B is inserted into the rotating portion 684A. The lever portion 684B has the same configuration as that of the lever portion 684B according to the first embodiment. The pin 643 provided to the thread capture member main body 641 of the third thread capture member 640 is inserted into the guide groove 684C of the lever portion 684B.

The coupling portion 684F is monolithically formed in the rotating portion 684A such that it protrudes toward the left side in the left-right direction and such that they form a single unit or they function as a single unit.

In the present embodiment, the second driving source 70 is configured including an electromagnetic solenoid 71. The electromagnetic solenoid 71 includes a round-bar-shaped movable portion 72 that can be moved in the front-rear direction. The front-end portion of the movable portion 72 is coupled to the coupling portion 684F via an unindicated pin. In the release state of the electromagnetic solenoid 71, the front end portion of the movable portion 72 is moved frontward. In the hold state shown in FIG. 18, the front end portion of the movable portion 72 is moved rearward.

Furthermore, an elastic member 73 is mounted on the movable portion 72 such that it forces the movable portion 72 toward the release-state side at all times. As the elastic member 73, a coil spring is employed, for example.

[Thread Cutting Method Including Thread Length Adjustment Method]

Description will be made regarding a thread cutting method including a thread length adjustment method employed for the thread cutting apparatus 6 of the sewing machine 1 according to the present embodiment. An ordinary thread cutting method for the thread cutting apparatus 6 without using the thread length adjustment mechanism 64 is the same as the ordinary thread cutting method employed in the sewing machine 1 according to the first embodiment. Accordingly, description thereof will be omitted.

The thread length adjustment method using the thread length adjustment mechanism 64 of the thread cutting apparatus 6 is basically the same as the thread length adjustment method employed in the sewing machine 1 according to the first embodiment. However, there is a difference between them in that, in the present embodiment, the adjustment blade portion 642 of the third thread capture member 640 is reciprocally moved by the third driving mechanism 68 and the second driving source 70.

Figure 17:
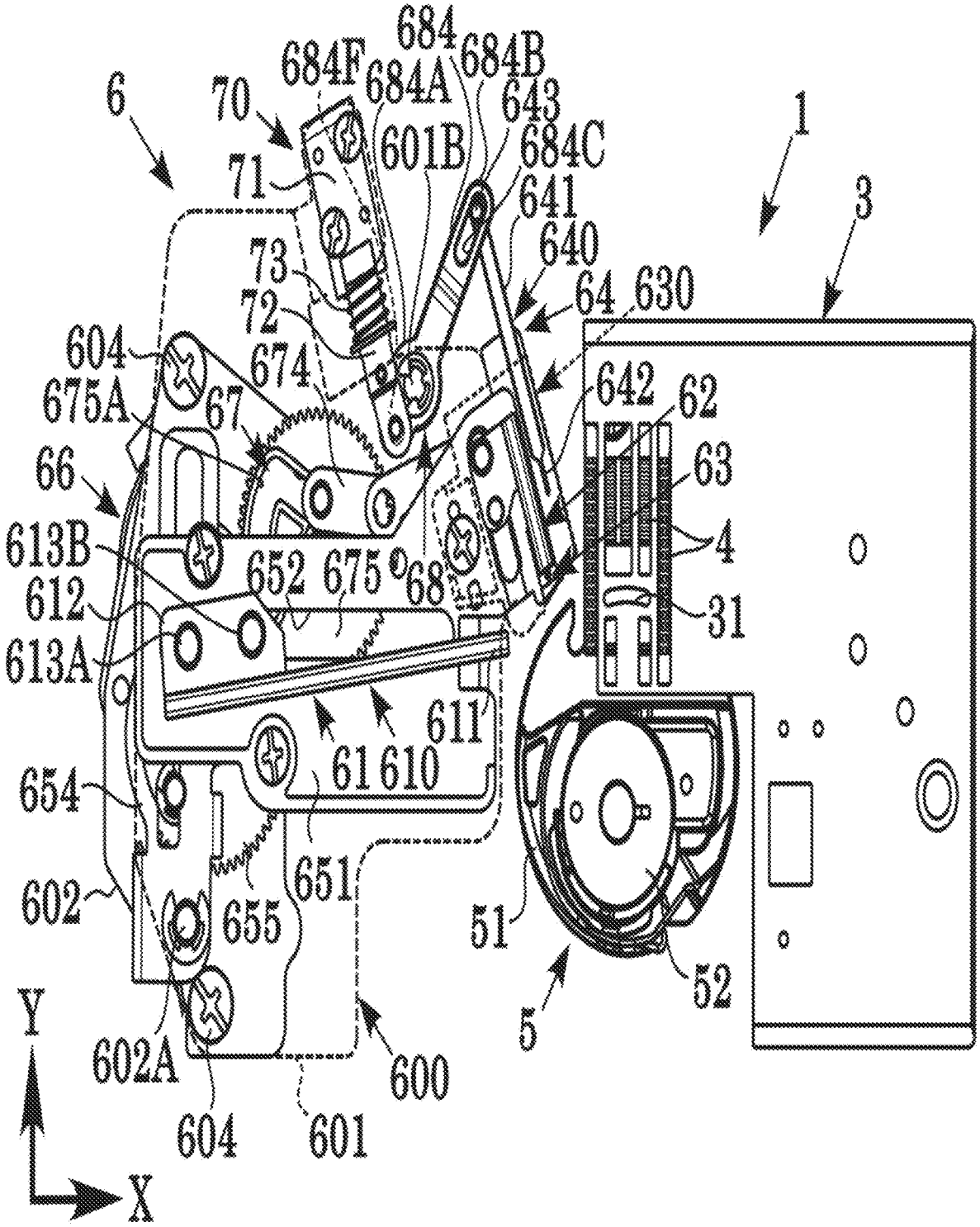
FIG. 17 is a plan view showing a part of components of the sewing machine and the thread cutting apparatus according to a second embodiment of the present invention corresponding to FIG. 5.
Figure 18:
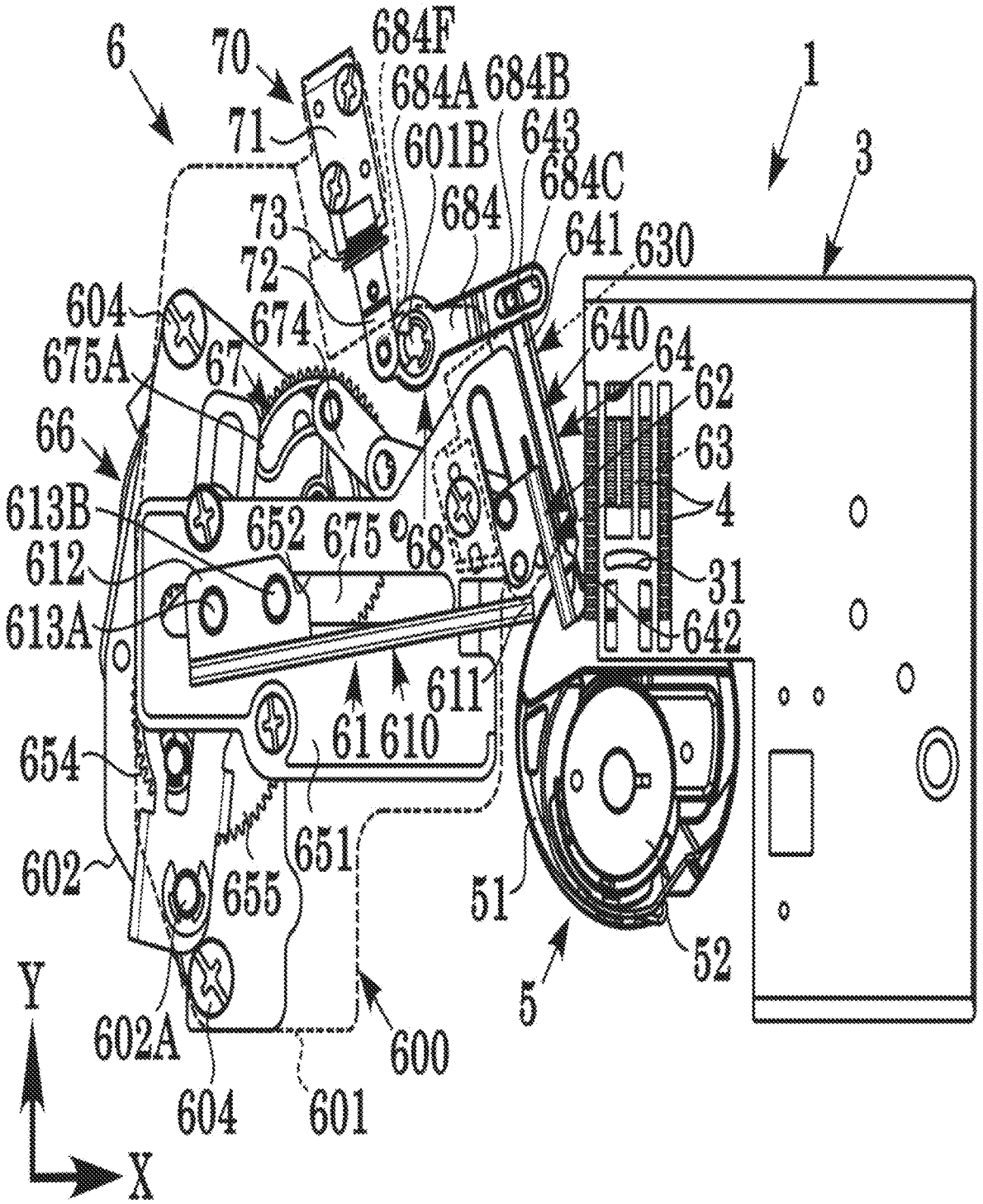
FIG. 18 is a plan view showing a part of components of the sewing machine and the thread cutting apparatus according to a second embodiment in a thread capture state corresponding to FIG. 17.

That is, as shown in FIG. 17, when the electromagnetic solenoid 71 of the second driving source 70 is set to the release state, the lever portion 684B of the third driving lever 684 is moved rearward, and the adjustment blade portion 642 is set to the home position positioned on the rear face side. In this state, the elastic member 73 assists the release state of the electromagnetic solenoid 71.

Upon setting the thread margin remaining on a cloth side to be sewn to a desired amount via the operation portion 24 described above with reference to FIG. 4, electric power is supplied to the electromagnetic solenoid 71 of the second driving source 70 by the control unit 27, which sets the electromagnetic solenoid 71 to the hold state. With this, as shown in FIG. 18, the third driving lever 684 is rotated in a clockwise manner with the rotating portion 684A as the center of rotation in a plan view, which advances the adjustment blade portion 642 of the third thread capture member 640 toward the front face side.

Subsequently, when the electromagnetic solenoid 71 is switched to the release state, the third driving lever 684 is rotated in a counterclockwise manner with the rotating portion 684A as the center of rotation, which returns the adjustment blade portion 642 toward the rear face side. At an intermediate position in the returning movement, the upper thread S2 and the lower thread S1 captured by the thread capture portion 611 of the first thread capture member 61 and the thread capture portion 621 of the second thread capture member 62 are captured and drawn rearward (see FIGS. 11 through 13). With this, the thread margin is adjusted to a desired amount for each of the upper thread S2 and the lower thread S1 remaining on the cloth side to be sewn.

Subsequently, as described above with reference to FIG. 9, the second thread capture member 62 returns in a state in which the upper thread S2 and the lower thread S1 are captured by the thread capture portion 611 of the first thread capture member 61, the thread capture portion 621 of the second thread capture member 62, and the adjustment blade portion 642. With this, the second thread capture member 62 and the cutting member 63 cut the upper thread S2 and the lower thread S1 in cooperation with each other.

By executing such a series of steps, the cutting method including the thread length adjustment method according to the present embodiment ends.

[Operation and Effects]

With the sewing machine 1 and the thread length adjustment method according to the present embodiment, this arrangement provides the same operation and effects as those provided by the sewing machine 1 and the thread length adjustment method according to the first embodiment described above.

Furthermore, as shown in FIG. 17, in the sewing machine 1 according to the present embodiment, the thread length adjustment mechanism 64 of the thread cutting apparatus 6 is provided with the second driving source 70. The second driving source 70 is configured including the electromagnetic solenoid 71. With the reciprocal movement of the adjustment blade portion 642 provided by the electromagnetic solenoid 71 that is switched between the release state and the hold state, such an arrangement allows the thread length adjustment mechanism 64 to adjust the thread margin to a desired amount. With the thread length adjustment mechanism 64, the thread margin can be adjusted to one from among two fixed values, e.g., 10 mm and 30 mm, for example.

Furthermore, the second driving source 70 is configured including the electromagnetic solenoid 71. The electromagnetic solenoid 71 is configured as a component having a size that is smaller than that of the stepping motor 691 included in the second driving source 69 (see FIG. 5 or the like) according to the first embodiment. This allows the thread length adjustment mechanism 64 to have a more compact configuration, thereby allowing the thread cutting mechanism 6 to be made more compact.

Third Embodiment

Figure 19:
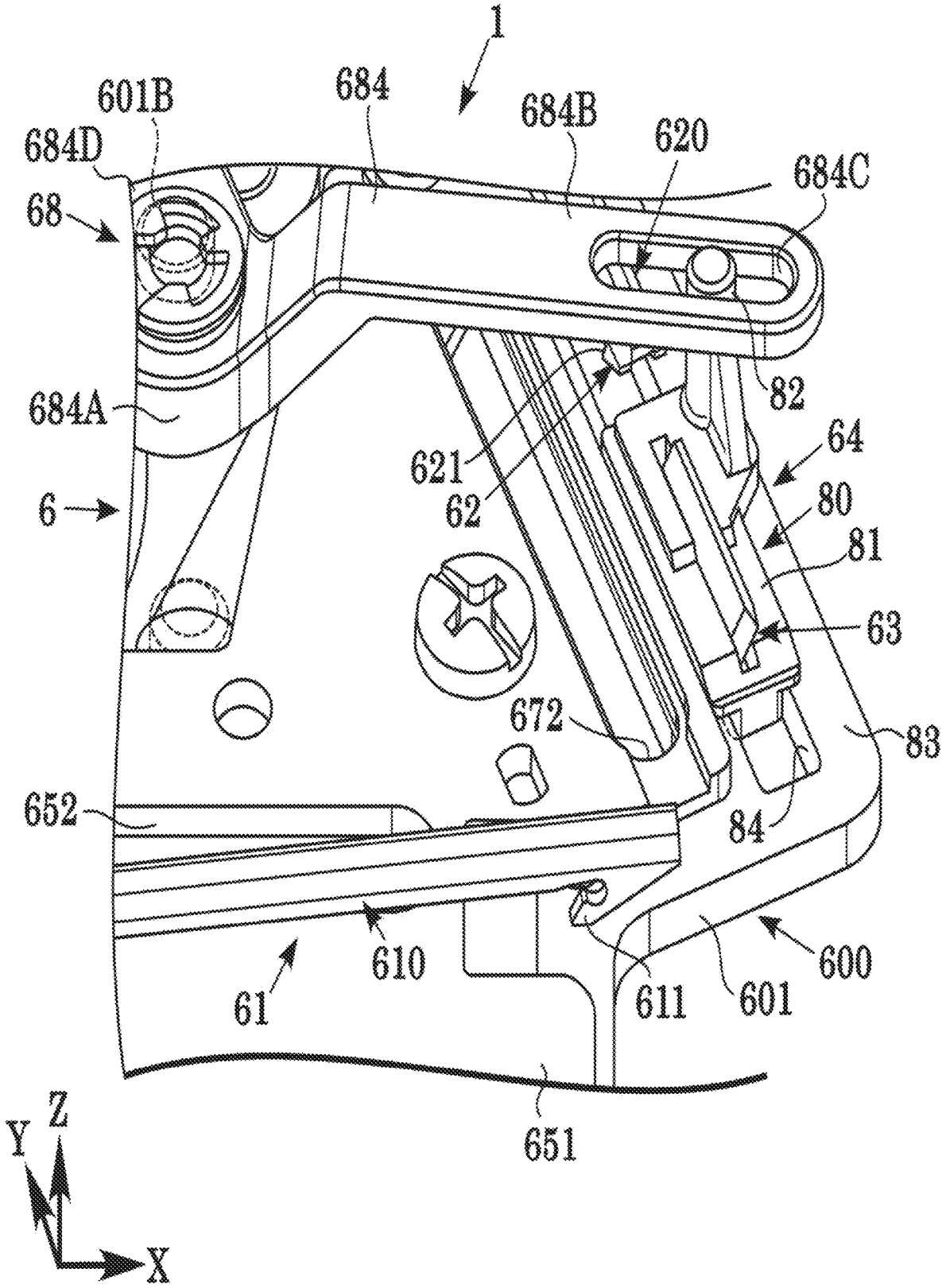
FIG. 19 is an enlarged principal-component perspective view showing an enlarged view of principal components of the thread cutting apparatus 6 mounted on the sewing machine according to a third embodiment of the present invention.
Figure 20:
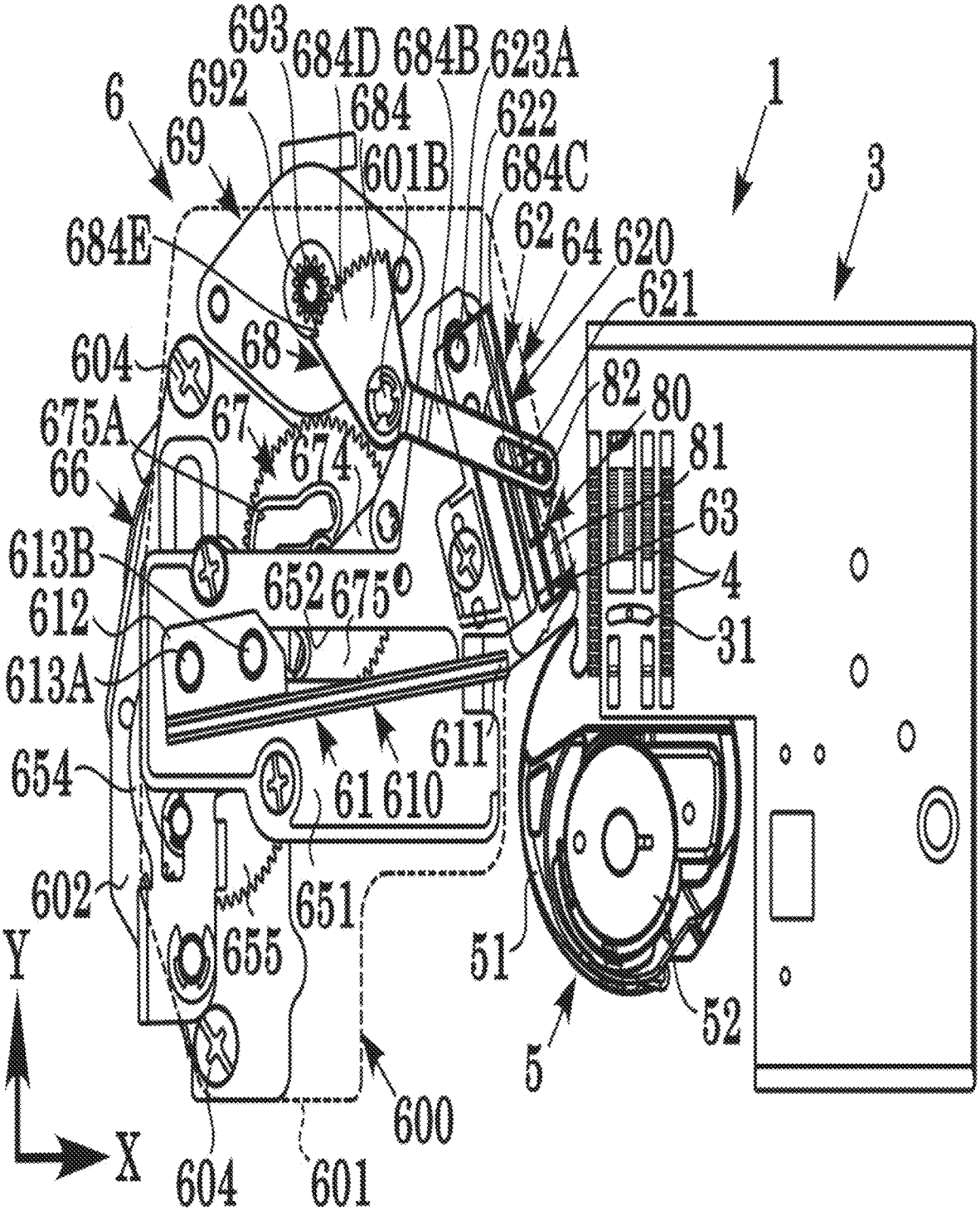
FIG. 20 is a plan view showing a part of components of the sewing machine and the thread cutting apparatus according to the third embodiment before a first thread cutting operation (at home position).

Description will be made with reference to FIGS. 19 through 23 regarding a sewing machine 1 and the thread cutting apparatus 6 provided to the sewing machine 1, and the thread cutting method including the thread adjustment method according to a third embodiment of the present invention. In the sewing machine 1 according to the present embodiment, the thread length adjustment mechanism 64 does not include the third thread capture member 640 and the adjustment blade portion 642, unlike the sewing machine 1 according to the first embodiment described above with reference to FIGS. 2 through 5. Instead, as shown in FIGS. 19 and 20, the thread length adjustment mechanism 64 is provided with a movement mechanism 80 configured to reciprocally move the cutting member 63.

[Configuration of Thread Cutting Apparatus 6]

In the sewing machine 1 according to the present embodiment, the thread cutting apparatus 6 includes the first thread capture member 61, the second thread capture member 62, the cutting member 63, and the thread length adjustment mechanism 64 as its main components. The first thread capture member 61, the second thread capture member 62, and the cutting member 63 each include substantially the same components as those included in the sewing machine 1 according to the first embodiment. Accordingly, description thereof will be omitted.

[Configuration of Thread Length Adjustment Mechanism 64]

As shown in FIGS. 19 and 20, the thread length adjustment mechanism 64 includes the movement mechanism 80 and the second driving source 69 as its main components.

The movement mechanism 80 is configured including the third driving mechanism 68 including substantially the same components as those of the third driving mechanism 68 (see FIGS. 2 through 5) of the thread length adjustment mechanism 64 according to the first embodiment. That is, the movement mechanism 80 is configured including a slide portion 81, a slide pin 82, an extending base portion 83, and a guide groove 84.

The third driving mechanism 68 of the movement mechanism 80 includes the third driving lever 684 as its main component. That is, the third driving lever 684 is configured including the rotating portion 684A, the lever portion 684B, and the extending portion 684D. Description has been made above in the first embodiment regarding the components of the third driving mechanism 68. Accordingly, detailed description of the components of the third driving mechanism 68 will be omitted. It should be noted that the extending portion 684D of the third driving lever 684 is coupled to the second driving source 69. The third driving lever 684 is configured such that the lever portion 684B is rotated (swung) with the rotating portion 684A as the center of rotation according to the driving force of the second driving source 69.

The extending base portion 83 is formed such that it further extends toward the right side from the right-side end portion of the first frame 601. The extending base portion 83 is formed with the first frame 601 as a single unit. The guide groove 84 is formed in the extending base portion 83 as an upper-lower-direction through hole at a position that corresponds to the lower side of the cutting member 63. The guide groove 84 is formed with the front-rear direction as its groove-length direction and with the left-right direction as its groove-width direction.

The slide portion 81 is formed to have a rectangular shape with the front-rear direction as its longitudinal direction in a plan view. Furthermore, the slide portion 81 is configured in the form of a T-shaped block formed such that its left-right-direction intermediate portion protrudes downward as viewed from the sewing machine user side. The cutting member 63 is detachably mounted on the upper portion of the slide portion 81. The protruding lower portion of the slide portion 81 is inserted into the guide groove 84. The slide portion 81 is configured such that it can be slid in the front-rear direction along the guide groove 84.

Here, the thread capture member main body 620 and the thread capture portion 621 of the second thread capture member 62 are each arranged at a position that corresponds to the upper side of the cutting member 63. Furthermore, the thread capture member main body 620 and the thread capture portion 621 are each designed to be reciprocally moved in the same direction as that of the reciprocal movement of the slide portion 81 along the guide groove 84.

The slide pin 82 is provided to an upper-rear portion of the slide portion 81 such that it protrudes upward. More specifically, the slide pin 82 is arranged at a position with an offset toward the right side with respect to the thread capture member main body 620 and the thread capture portion 621 as viewed from the sewing machine user side, and such that no interference occurs with the reciprocal movement of the thread capture member main body 620 and the thread capture portion 621. The slide pin 82 is inserted into the guide groove 684C provided as a through hole to the lever portion 684B of the third driving lever 684.

The thread cutting adjustment mechanism 64 thus configured as described above includes the movement mechanism 80. This allows the cutting member 63 to be moved relative to the hole 31 of the needle plate 3. With the present embodiment, the thread cutting adjustment mechanism 64 is capable of reciprocally moving the cutting member 63 in the front-rear direction in a direction matching the reciprocal movement direction of the thread capture member main body 620 and the thread capture portion 621 of the second thread capture member 62.

[Thread Cutting Method Including Thread Length Adjustment Method]

Description will be made with reference to FIGS. 20 through 23 in addition to FIG. 19 regarding a thread cutting method including a thread length adjustment method employed in the thread cutting apparatus 6 of the sewing machine 1 according to the present embodiment. Here, description will be made regarding a thread length adjustment method for switching the thread margin between two settings, i.e., a minimum margin setting in which the thread margin is set to a minimum amount remaining on the cloth side to be sewn and a maximum margin setting in which the thread margin is set to a maximum amount.

(1) Thread Length Adjustment Method for Providing Minimum Thread Margin Remaining on Cloth Side to be Sewn First, before the operation of the thread cutting apparatus 6, the thread margin to be set for the cloth side to be sewn is set to a desired minimum amount via the operating unit 24 described above with reference to FIGS. 1 and 4. Here, the thread margin is set to 10 mm, for example. The desired amount of the thread margin thus set is displayed on the display unit 25 in the form of a numerical value, for example.

The second driving source 69 is driven by the control unit 27 based on the thread margin thus set by the operating unit 24. The second driving source 69 operates the thread length adjustment mechanism 64 via the movement mechanism 80. More specifically, the driving gear 693 of the second driving source 69 shown in FIG. 20 is rotated in a counterclockwise manner in a plan view, which rotates the third driving lever 684 of the third driving mechanism 68 of the movement mechanism 80 in a clockwise manner with the rotating portion 684A as the center of rotation (see FIG. 19).

With this rotation, the lever portion 684B advances the slide portion 81 via the slide pin 82 from the rear face side toward the front face side. The cutting member 63 mounted on the slide portion 81 is moved to the frontmost cutting position. With the thread length adjustment mechanism 64, when the cutting member 63 is advanced to the frontmost cutting position, the cutting member 63 is set to a home position that corresponds to the setting for providing a minimum thread margin remaining on the cloth side to be sewn.

Upon operating the thread cutting apparatus 6 via the control unit 27 described above with reference to FIG. 4, as with the thread cutting method described above with reference to FIGS. 5 through 8, the upper thread S2 and the lower thread S1 are captured by the thread capture portion 611 of the first thread capture member 61 and the thread capture portion 621 of the second thread capture member 62.

Figure 21:
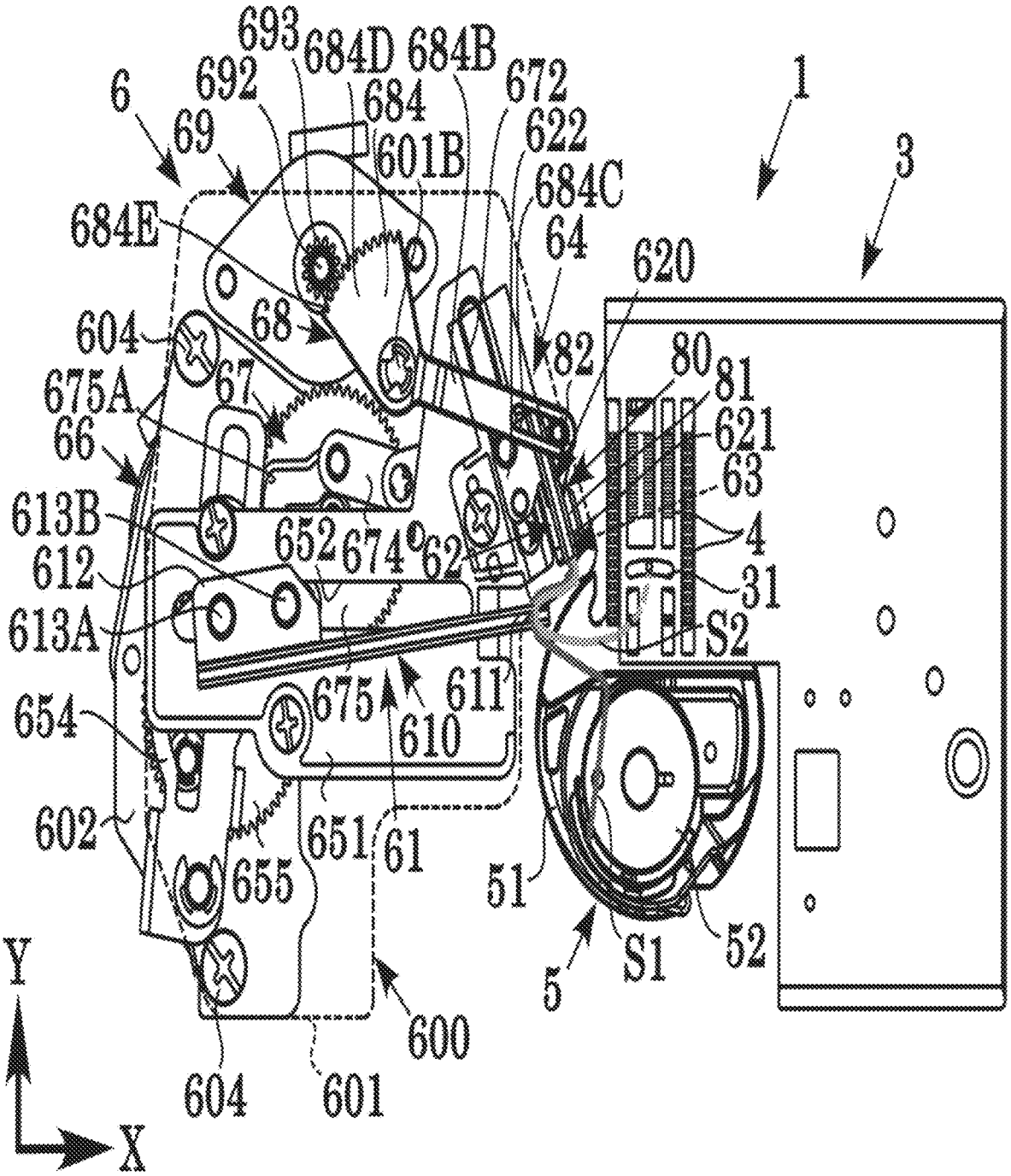
FIG. 21 is a plan view showing a part of components of the sewing machine and the thread cutting apparatus in the first thread cutting state shown in FIG. 20.

As shown in FIG. 21, the second thread capture member 62 starts its returning movement. In this stage, the upper thread S2 and the lower thread S1 are captured by the thread capture portion 611 of the first thread capture member 61 and the thread capture portion 621 of the second thread capture member 62. By performing the returning movement of the second thread capture member 62, the thread capture member main body 620 and the thread capture portion 621 of the second thread capture member 62 are moved from the front face side toward the rear face side. In this stage, the second thread capture member 62 and the cutting member 63 cut the upper thread S2 and the lower thread S1 in cooperation with each other. That is, in this state, the cutting member 63 is set to the frontmost cutting position. Accordingly, the thread margin of each of the upper thread S2 and the lower thread S1 remaining on the cloth side to be sewn is adjusted to its desired minimum amount by the thread length adjustment mechanism 64.

Subsequently, the first thread capture member 61 and the second thread capture member 62 are returned to the home position described above with reference to FIG. 20. In this stage, the thread cutting method including the thread length adjustment method employed in the thread cutting apparatus 6 ends.

(2) Thread Length Adjustment Method for Providing Maximum Thread Margin Remaining on Cloth Side to be Sewn First, before the operation of the thread cutting apparatus 6, the thread margin to be set for the cloth side to be sewn is set to a desired maximum amount via the operating unit 24 (see FIGS. 1 and 4). Here, the thread margin is set to 30 mm, for example. The desired amount of the thread margin thus set is displayed on the display unit 25 in the form of a numerical value, for example.

Figure 22:
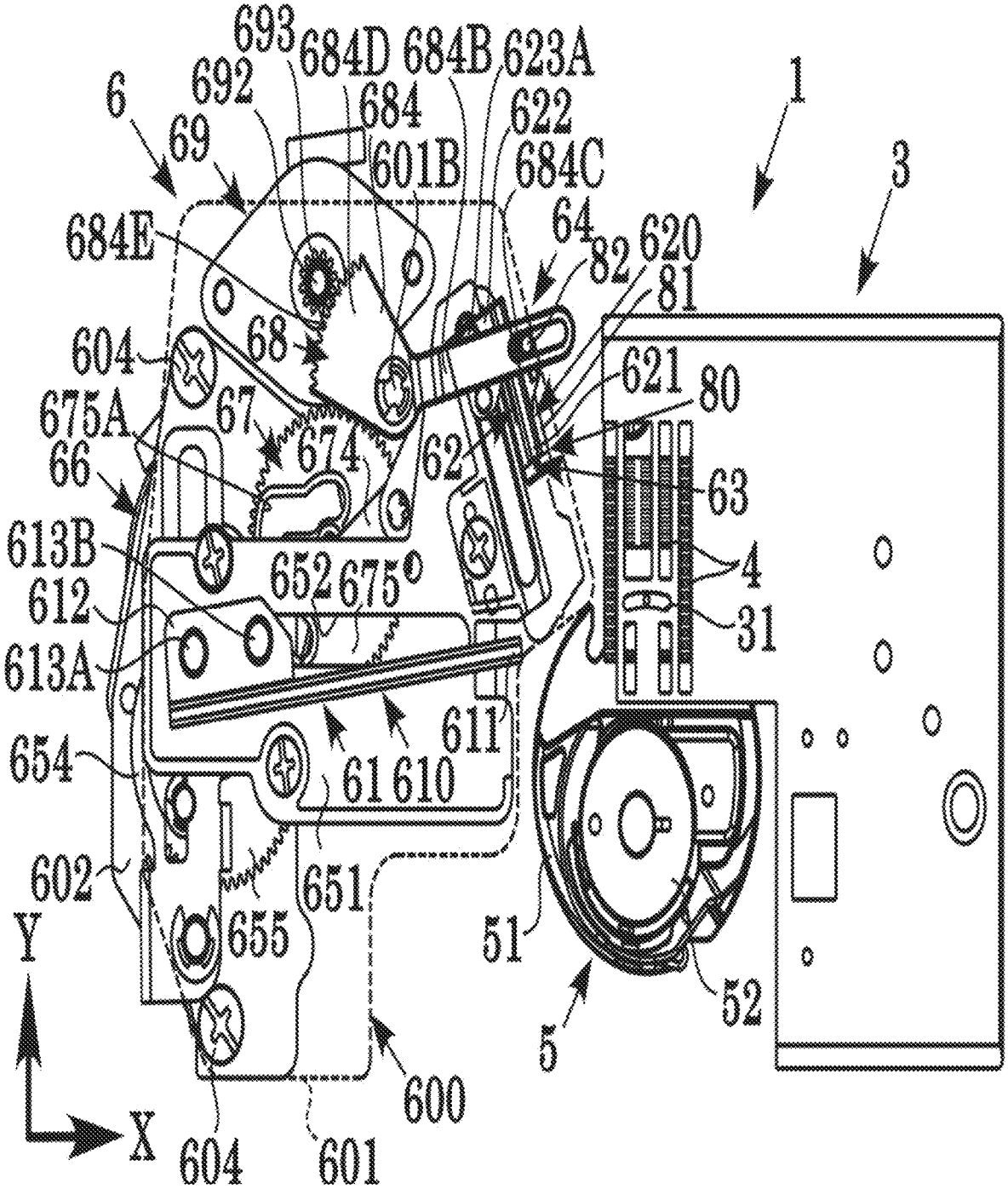
FIG. 22 is a plan view showing a part of components of the sewing machine and the thread cutting apparatus according to the third embodiment before a second thread cutting operation (at home position) corresponding to FIG. 20.

The second driving source 69 is driven by the control unit 27 based on the thread margin thus set by the operating unit 24. The second driving source 69 operates the thread length adjustment mechanism 64 via the movement mechanism 80. More specifically, the driving gear 693 of the second driving source 69 shown in FIG. 22 is rotated in a clockwise manner in a plan view, which rotates the third driving lever 684 of the third driving mechanism 68 of the movement mechanism 80 in a counterclockwise manner with the rotating portion 684A as the center of rotation.

With this rotation, the lever portion 684B returns the slide portion 81 via the slide pin 82 from the front face side toward the rear face side. The cutting member 63 mounted on the slide portion 81 is moved to the rearmost cutting position. With the thread length adjustment mechanism 64, when the cutting member 63 is moved to the rearmost cutting position, the cutting member 63 is set to a home position that corresponds to the setting for providing a maximum thread margin remaining on the cloth side to be sewn.

Upon operating the thread cutting apparatus 6 via the control unit 27 (see FIG. 4), as with the thread cutting method described above with reference to FIGS. 5 through 8, the upper thread S2 and the lower thread S1 are captured by the thread capture portion 611 of the first thread capture member 61 and the thread capture portion 621 of the second thread capture member 62.

Figure 23:
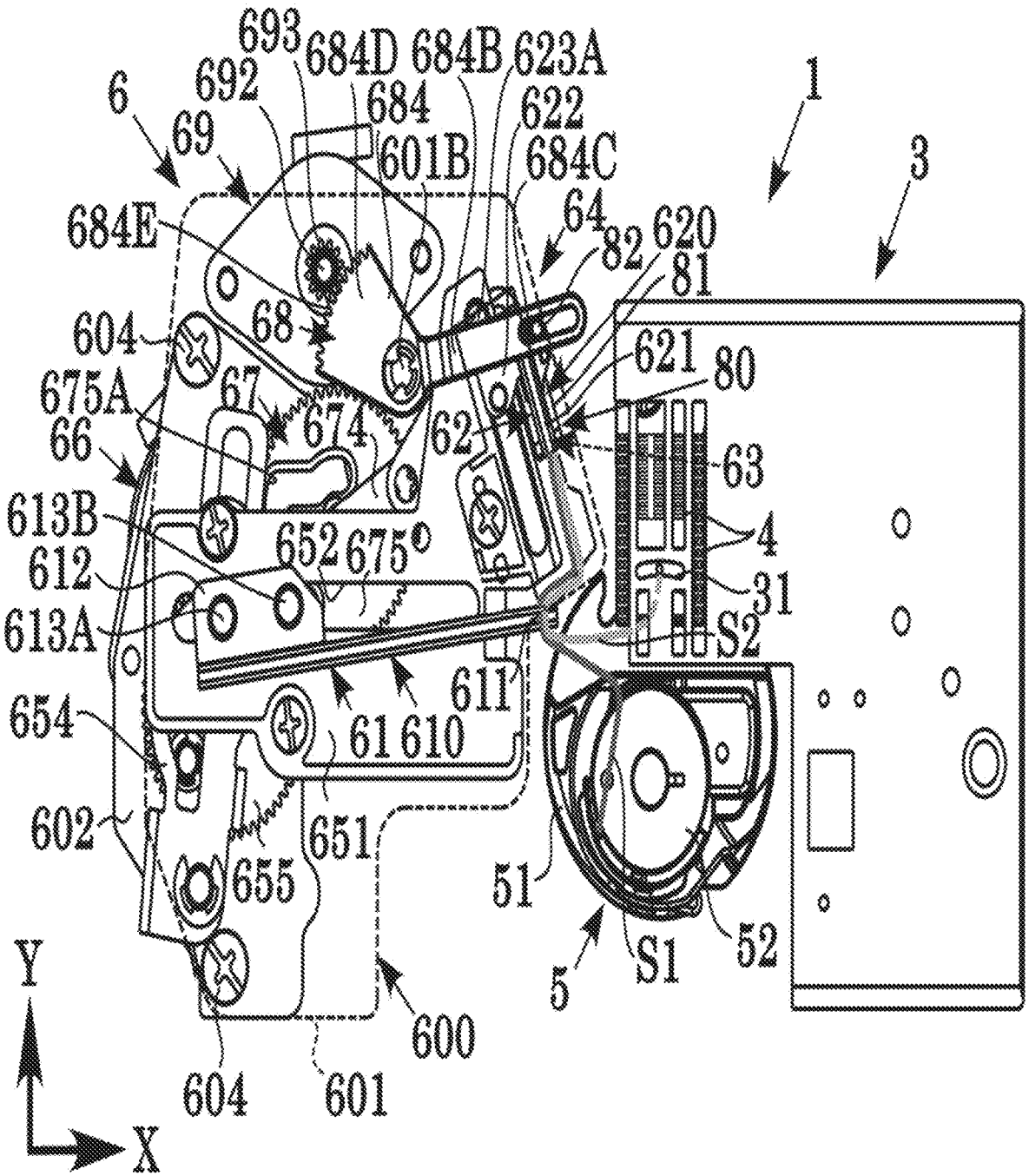
FIG. 23 is a plan view showing a part of components of the sewing machine and the thread cutting apparatus shown in FIG. 22 in the second thread cutting state.

As shown in FIG. 23, the second thread capture member 62 starts its returning movement. In this stage, the upper thread S2 and the lower thread S1 are captured by the thread capture portion 611 of the first thread capture member 61 and the thread capture portion 621 of the second thread capture member 62. By performing the returning movement of the second thread capture member 62, the thread capture member main body 620 and the thread capture portion 621 of the second thread capture member 62 are moved from the front face side toward the rear face side. In this stage, the second thread capture member 62 and the cutting member 63 cut the upper thread S2 and the lower thread S1 in cooperation with each other. That is, in this state, the cutting member 63 is set to the rearmost cutting position. Accordingly, the thread margin of each of the upper thread S2 and the lower thread S1 remaining on the cloth side to be sewn is adjusted to its desired maximum amount by the thread length adjustment mechanism 64.

Subsequently, the first thread capture member 61 and the second thread capture member 62 are returned to the home position described above with reference to FIG. 22. In this stage, the thread cutting method including the thread length adjustment method employed in the thread cutting apparatus 6 ends.

It should be noted that the thread length adjustment mechanism 64 allows the sewing machine 1 according to the present embodiment to support an intermediate cutting position defined between the frontmost-side cutting position and the rearmost-side cutting position as a cutting position for the cutting member 63. With this, the thread length adjustment mechanism 64 is capable of adjusting the thread margin remaining on the cloth side to be sewn to a desired amount from among 15 mm, 20 mm, and 25 mm, for example.

Furthermore, the thread length adjustment mechanism 64 is capable of setting the thread margin remaining on the cloth side to be sewn to a desired amount, e.g., 16 mm, in a range between the minimum thread margin, e.g., 10 mm, and the maximum thread margin, e.g., 30 mm.

[Operation and Effects]

With the sewing machine 1 and the thread length adjustment method according to the present embodiment, the same operation and effects can be provided as those provided by the sewing machine 1 and the thread length adjustment method according to the first embodiment described above.

Furthermore, in the sewing machine 1 according to the present embodiment shown in FIG. 1, the thread length adjustment mechanism 64 is configured including the movement mechanism 80 as shown in FIGS. 19 and 20. The movement mechanism 80 moves the cutting member 63 relative to the hole 31 of the needle plate 3.

This allows the sewing machine 1 according to the present embodiment to eliminate a component for the third thread capture member 640 including the adjustment blade portion 642, as compared with the sewing machine 1 according to the first embodiment. This allows the thread length adjustment mechanism 64 to have a simplified configuration.

OTHER EMBODIMENTS

The present invention is not restricted to the embodiments described above. Rather, various changes may be made without departing from the scope and spirit of the present invention.

For example, with the present invention, a combination may be made with respect to the sewing machine 1 according to the second embodiment and the sewing machine 1 according to the third embodiment. Specifically, in the thread length adjustment mechanism 64 of the sewing machine 1 according to the third embodiment, the second driving source 69 may be replaced by the second driving source 70 including the electromagnetic solenoid 71. Also, the driving force of the second driving source 70 may be used to support the reciprocal movement of the cutting member 63.

In the description of the sewing machine 1 according to the first embodiment, the guide portion 43 is provided to the feed dog 4. Also, with the present invention, the guide portion 43 may be provided to the first frame 601 or the first slide guide 651.

DESCRIPTION OF THE REFERENCE NUMERALS

1 sewing machine, 2 sewing machine main body, 21 bed, 24 operating unit, 25 display unit, 27 control unit, 3 needle plate, 31 hole (needle hole), 4 feed dog, 43 guide portion, 5 rotating hook, 6 thread cutting apparatus, 61 first thread capture member, 610, 620, 624 thread capture member main body, 62 second thread capture member, 63 cutting member, 64 thread length adjustment mechanism, 640 third thread capture member, 642 adjustment blade portion (thread capture portion), 65 first driving mechanism, 66 first driving source, 67 second driving mechanism, 68 third driving mechanism, 69, 70 second driving source, 71 electromagnetic solenoid, 80 movement mechanism.

What is claimed is:

1. A sewing machine comprising:

a cutting member configured to cut an upper thread and a lower thread between a hole of a needle plate and a rotating hook;

a thread length adjustment mechanism configured to adjust a length of the upper thread and the lower thread extending from the hole of the needle plate and the cutting member;

an operating unit configured to set a thread margin of the upper thread and the lower thread to be used for the thread length adjustment mechanism;

a driving source configured to drive the thread length adjustment mechanism; and a controller configured to drive the driving source based on the thread margin set by the operating unit.

2. The sewing machine according to claim 1, wherein the thread length adjustment mechanism is arranged between the hole of the needle plate and the cutting member, and is configured including an adjustment blade portion that is capable of capturing and moving the upper thread and the lower thread.

3. The sewing machine according to claim 2, comprising a guide portion arranged between the hole of the needle plate and the adjustment blade portion, and configured to guide the upper thread and the lower thread when the adjustment blade portion is moved.

4. The sewing machine according to claim 1, wherein the thread length adjustment mechanism is configured including a movement mechanism that moves the cutting member relative to the hole of the needle plate.

5. The sewing machine according to claim 1, further comprising a thread capture member configured to capture the upper thread and the lower thread between the hole of the needle plate and the rotating hook, and to move relative to the cutting member.

* * * * *